US006142577A

United States Patent [19]

Tayama et al.

[11] Patent Number: 6,142,577

[45] Date of Patent: Nov. 7, 2000

[54] HYDRAULIC MUCK HANDLING SYSTEM FOR TUNNEL BORING MACHINE

[75] Inventors: Minoru Tayama, Ibaraki-ken; Kiyoshi Tsuchiya, Tsuchiura; Yasuaki Ishikawa, Ibaraki-ken; Masaaki Miki, Sakai; Ryoichi Arita, Nishinomiya; Kazunori Ueda, Tsuchiura, all of Japan

[73] Assignees: Hitachi Construction Machinery Co., Ltd., Tokyo; Sankei Corporation, Osaka, both of Japan

[21] Appl. No.: 09/066,458

[22] PCT Filed: Sep. 2, 1997

[86] PCT No.: PCT/JP97/03071

§ 371 Date: Apr. 30, 1998

§ 102(e) Date: Apr. 30, 1998

[87] PCT Pub. No.: WO98/10170

PCT Pub. Date: Mar. 12, 1998

[30] Foreign Application Priority Data

| | | | |
|---|---|---|---|
| Sep. 3, 1996 | [JP] | Japan | 8-233107 |
| Dec. 27, 1996 | [JP] | Japan | 8-351147 |
| Dec. 27, 1996 | [JP] | Japan | 8-351180 |
| Mar. 28, 1997 | [JP] | Japan | 9-77417 |

[51] Int. Cl.[7] ..... E21D 9/12

[52] U.S. Cl. ..... 299/56; 405/138

[58] Field of Search ..... 299/56; 405/138, 405/141

[56] References Cited

U.S. PATENT DOCUMENTS

| | | | |
|---|---|---|---|
| 3,350,889 | 11/1967 | Sturm | 405/138 |
| 4,116,487 | 9/1978 | Yamazaki et al. | 405/141 |
| 4,165,129 | 8/1979 | Sugimoto et al. | 299/56 |
| 4,629,255 | 12/1986 | Babendererde | 299/56 |
| 4,844,656 | 7/1989 | Babendererde et al. | 405/138 |

FOREIGN PATENT DOCUMENTS

| | | |
|---|---|---|
| 0 208 816 | 1/1987 | European Pat. Off. . |
| 3437996 | 4/1986 | Germany . |
| 54-131220 | 5/1991 | Japan . |
| 4-11720 | 3/1992 | Japan . |
| 4-49274 | 11/1992 | Japan . |
| 9-132994 | 5/1997 | Japan . |

*Primary Examiner*—Eileen D. Lillis
*Assistant Examiner*—John Kreck
*Attorney, Agent, or Firm*—Mattingly, Stanger & Malur, P.C.

[57] ABSTRACT

A tunnel boring machine for collecting earth excavated upon rotation of a cutter disk includes a non-pressurized chamber behind the cutter disk for collecting earth excavated by the cutter disk and discharging the earth with a carrying fluid. The machine includes a first open tank arranged in the non-pressurized chamber which serves as a vessel for containing the carrying fluid as well as a hopper for collecting excavated earth. Carrying fluid supply apparatus is provided for supplying the carrying fluid to the first open tank and suction/discharge apparatus is provided for sucking and discharging the carrying fluid supply to the first open tank rearwardly together with the collected earth. Water level control apparatus provided for monitoring a water level of a carrying fluid in the first open tank and keeping the water level between a minimum water level and a maximum water level.

21 Claims, 22 Drawing Sheets

| DIGGING SPEED (cm/min) | VARIATION DEPTH OF WATER LEVEL (mm) |
|---|---|
| 5 | 75 |
| 7 | 135 |
| 8 | 137 |
| 8.9 | 140 |

(MACHINE DIAMETER 2.3m)

HYDRAULIC MUCK HANDLING SYSTEM FOR TUNNEL BORING MACHINE

TECHNICAL FIELD

The present invention relates to a tunnel boring method and a tunnel boring machine for digging into a working face by a cutter disk to bore a tunnel while discharging excavated earth with a carrying fluid comprising mainly water, and more particularly to a tunnel boring method and a tunnel boring machine which are suitable for digging into the ground having a non-disintegrative feature.

BACKGROUND ART

Working faces to be dug in by tunnel boring machines are divided into the ground having a not-disintegrative geological feature and the ground having a disintegrative geological feature. When digging in the ground having a disintegrative geological feature, a method called a slurry pressure technique is generally used. According to this method, a water-tight chamber enclosed by a partition wall is formed on the back side of a cutter disk, and compressed water is supplied to the chamber to fill it with water under pressure, thereby preventing a collapse of the working face with the water pressure of the compressed water. Further, the earth excavated by the cutter disk is collected in a lower portion of the chamber, and then discharged along with the compressed water rearwardly of the partition wall under the pressure of the compressed water in the chamber through a discharge pipe connected to the partition wall.

Such a slurry pressure technique is extremely complicated and expensive in equipment because sealing mechanisms are required between a body of the tunnel boring machine and the surrounding natural ground and between the exterior and interior of the boring machine body for keeping water-tight the chamber on the back side of the cutter disk. For that reason, the slurry pressure technique is used only when digging in the ground having a disintegrative geological feature, and a non-pressure technique is generally used when digging in the ground having a non-disintegrative geological feature.

As a tunnel boring machine operable in a non-pressure manner to dig into ground having a non-disintegrative geological feature, there is a known conventional one wherein carrying-out means such as a belt conveyor or a screw conveyor is disposed on the back side of a cutter disk. The earth excavated by the cutter disk is discharged rearward by the carrying-out means.

Further, to make smaller the size of the carrying-out means and reduce frequency in occurrence of troubles thereof, JP, Y, 4-49274 and JP, B, 4-11720 propose a tunnel boring machine using a jet pump as carrying-out means. According to this proposal, a hopper is disposed in a lower portion of a chamber formed between a cutter disk and a partition wall, and the earth excavated by the cutter disk is collected in the hopper. The jet pump having an earth take-in port formed in its casing is attached to a bottom portion of the hopper, and a discharge pipe is connected to a casing outlet of the jet pump. Compressed water is supplied to the jet pump through a piping from a supply pump provided rearwardly of the boring machine. The compressed water is accelerated by a nozzle of the jet pump, and then depressurized in a throat portion downstream of the earth take-in port to produce a negative pressure. With a water flow developed under the negative pressure, the earth in the hopper is discharged through the earth take-in port and then the discharge pipe.

SUMMARY OF THE INVENTION

In an earth carrying system using such a jet pump, however, if a foreign matter enters the accelerating nozzle and makes it clogged, earth is accumulated in the throat portion and the casing provided with the earth take-in port, causing the interior of the casing to be gradually brought into a closed state. Eventually, it becomes impossible to propel the earth further. In the event the earth can thus no longer be propelled to advance, repairing steps of disassembling the casing of the jet pump and cleaning up the interior of the jet pump are required. This raises a problem that since the tunnel boring machine is kept in a shutdown state during the repairing steps and a lot of time is necessary to complete the work of disassembling and cleaning-up for restoration, extension of the term of works and an increase in the construction cost.

Further, the jet pump is poor in pump efficiency because of the structure specific to it, and when applied to earth carrying systems adapted for a medium or large diameter, it requires a large-scale power source and is not preferable from the practical point of view. As a result, there is a problem that the jet pump can be used with only limited boring machines having a small diameter, and cannot be applied to such tunnel boring machines that have a medium diameter.

An object of the present invention is to provide a tunnel boring method and a tunnel boring machine which can smoothly continuously carry out excavated earth and has a great earth carrying-out capability by using a non-pressure method for digging in the ground having a non-disintegrative geological feature.

To achieve the above object, the present invention is constructed in summary as follows.

(1) According to the present invention, in a tunnel boring method of collecting earth excavated upon rotation of a cutter disk and discharging the earth with a carrying fluid being mainly water, the method comprises the steps of arranging an open tank, serving also as a hopper for collecting the excavated earth, on the back side of the cutter disk, supplying the carrying fluid to the open tank, sucking and discharging the carrying fluid supplied to the open tank rearward together with the collected earth, and monitoring a water level of the carrying fluid in the open tank and making control to keep the water level constant.

By so using the open tank as a hopper, supplying the carrying fluid to the open tank, and then sucking and discharging the carrying fluid in the open tank, the earth collected in the open tank is sucked and discharged along with the carrying fluid. At this time, since the suction and discharge of the carrying fluid including the earth from the open tank are performed while maintaining a proper water level through water level control, a pump is prevented from rotating idly due to a lowering of the water level. Also, since such a small-diameter nozzle such as a jet pump is not used, pipes are prevented from being clogged with small stones or the like. Therefore, the excavated earth can be smoothly continuously discharged. Further, since an ordinary pump, such as a centrifugal pump, with high efficiency can be used as a drive source for sucking and discharging the carrying fluid, a greater earth carrying-out capability than obtainable with a jet pump can be achieved. In other words, a tunnel boring method is realized which can smoothly continuously carry out the excavated earth and has a great earth carrying-out capability by using a non-pressure method for digging in the ground having a non-disintegrative geological feature.

(2) Also, according to the present invention, in a tunnel boring machine for collecting earth excavated upon rotation of a cutter disk and discharging the earth with a carrying fluid being mainly water, the apparatus comprises a first open tank arranged on the back side of the cutter disk and serving also as a hopper for collecting the excavated earth, carrying fluid supply means for supplying the carrying fluid to the first open tank, suction/discharge means for sucking and discharging the carrying fluid supplied to the first open tank rearward together with the collected earth, and water level control means for monitoring a water level of the carrying fluid in the first open tank and making control to keep the water level constant.

The tunnel boring machine can implement the method of the above (1), and hence can smoothly continuously carry out the excavated earth and has a great earth carrying-out capability by using a non-pressure method for digging into the ground having a non-disintegrative geological feature.

(3) In the above (2), preferably, the carrying fluid supply means includes a supply pipe connected to the first open tank, and a pouring port of the supply pipe is positioned below a lower limit of a variation in depth of the water level as results when the water level of the carrying fluid is controlled by the water level control means.

With that feature, because of the pouring port of the supply pipe being not exposed to air, when the carrying fluid is poured into the first open tank from the supply pipe, air is avoided from mixing into the carrying fluid in the first open tank, and the suction/discharge means can suck and discharge the carrying fluid together with the earth without causing a reduction in efficiency due to mixing of air in the water.

(4) In the above (2), preferably, the suction/discharge means includes at least one centrifugal pump.

By so providing a centrifugal pump as a drive source for the suction/discharge means, superior pump efficiency can be achieved and even the carrying fluid mixed with the earth can be smoothly sucked and discharged with a high carrying capability.

(5) In the above (2), preferably, the suction/discharge means includes a suction pipe connected to the first open tank, and the water level control means controls the water level with a target water level set to Lo expressed by;

$$Lo \geqq 2d + (\Delta h/2)$$

where Δh is the variation in depth of the water level and d is the diameter of a suction port of the suction pipe.

By so setting at least a value of the diameter of the suction pipe as the height of a safety region for the target water level in the water level control, the target water level can be set to a proper value depending on the suction/discharge amount of the carrying fluid.

(6) In the above (2), preferably, the carrying fluid supply means includes a supply pump for delivering the carrying fluid under pressure to the first open tank from the ground surface, and the water level control means comprises water level detecting means for detecting the water level of the carrying fluid in the first open tank and means for controlling the supply pump of the carrying fluid supply means in accordance with a value detected by the water level detecting means.

With that feature, the water level in the first open tank can be maintained.

(7) In the above (6), preferably, the water level detecting means includes a water-pressure gauge for detecting a water pressure at the bottom of the first open tank and estimates the water level from the pressure detected by the water-pressure gauge.

With that feature, the water level can be detected by a sensor having no moving parts (a water-level gauge), and hence the sensor can be installed more easily and is less likely to fail.

(8) In the above (2), preferably, the carrying fluid supply means includes a first supply pipe connected to the first open tank, the suction/discharge means includes a suction pipe connected to the first open tank, and the first open tank comprises opposing sloped plates in pairs extending in the axial direction of the cutter disk and sloped to come closer to each other as they go down, and a bottom plate continuously joined to lower ends of the opposing sloped plates to define a bottom passage in the first open tank, the suction pipe having a suction port positioned at a rear end of the bottom passage, and the first supply pipe having a pouring port positioned at a front end of the bottom passage to face the suction port of the suction pipe, With that feature, ejection of the carrying fluid through the pouring port of the supply pipe positioned at the front end of the bottom passage and suction of the carrying fluid through the suction port of the suction pipe positioned at the rear end of the bottom passage are effected in a combined manner so that a large flowing force is concentrated in the bottom passage to increase a great earth carrying-out capability. Further, since the excavated earth drops down to the bottom passage while sliding over the opposing sloped plates, the excavated earth can be smoothly discharged. In addition, since the flowing force produced upon the carrying fluid ejected through the pouring port of the supply pipe can act to collapse a mass of the earth dropped down to the bottom passage, it is possible to prevent the formation of a bridge due to gravel-like rock fragments and clayish earth.

(9) In the above (8), preferably, the carrying fluid supply means further includes a second supply pipe connected to the first open tank, and a pouring port of the second supply pipe is positioned obliquely toward the bottom passage at a level above the pouring port of the first supply pipe.

With that feature, since the carrying fluid is ejected obliquely from the second supply pipe toward the bottom passage, the flowing force is further increased to provide a greater earth carrying-out capability. In addition, a mass of gravel-like rock fragments and clayish earth can be more effectively collapsed and the formation of a bridge can be more surely avoided.

(10) In the above (9), preferably, the tunnel boring machine further comprises carrying fluid return means for returning part of the carrying fluid discharged by the suction/discharge means, and one of the first supply pipe and the second supply pipe is a return pipe of the carrying fluid return means.

By so providing the carrying fluid return means, the flow rate supplied to the first open tank is replenished by the returned carrying fluid; hence the supply flow rate from the carrying fluid supply means can be reduced and the apparatus can be operated with better efficiency. Also, by using one of the supply pipes as the return pipe, the operation of the above (9) can also be developed by the carrying fluid ejected from the return pipe.

(11) In the above (2), preferably, the tunnel boring machine further comprises an air-purging second open tank allowing at least part of the carrying fluid including the earth and delivered from the first open tank to reside therein, a crusher provided between the first open tank and the second open tank for crushing rock fragments included in the earth discharged along with the carrying fluid, and a discharge pump provided downstream of the second open tank for delivering under pressure the carrying fluid in the second open tank together with the earth to the ground surface, and the suction/discharge means is provided between the first open tank and the crusher and includes a suction pump for sucking the carrying fluid in the first open tank together with the earth.

By so providing the air-purging second open tank, the discharge pump downstream of the second open tank can deliver the carrying fluid under pressure together with the earth without suffering a reduction in efficiency caused by mixing of air.

Also, by providing the suction pump upstream of the crusher, the length of a pipe interconnecting the first open tank and the suction pump can be reduced, and hence the carrying fluid including the earth can be sucked and discharged without causing a significant reduction in efficiency. In addition, since a pressure drop due to resistance of the flow passage is minimized, it is also possible to minimize cavitation that is possibly occurred upon air mixed in the water turning to bubbles under a pressure drop.

Further, with the provision of the crusher, the earth including rock fragments crushed into smaller pieces is sent to the discharge pump, and therefore the carrying fluid including the earth can be smoothly delivered under pressure by the discharge pump.

(12) In the above (11), preferably, the tunnel boring machine further comprises carrying fluid return means including a return pump for returning the carrying fluid in the second open tank to the first open tank, and a suction flow rate provided by the suction pump is set to be greater than a delivery flow rate provided by the discharge pump, and a return flow rate provided by the return pump is set to be substantially equal to a differential flow rate between the suction flow rate and the delivery flow rate.

By so providing the carrying fluid return means, the flow rate supplied to the first open tank is replenished by the returned carrying fluid; hence the supply flow rate from the carrying fluid supply means can be reduced and the apparatus can be operated with better efficiency.

Also, since a flow rate of the carrying fluid delivered from the first open tank to the second open tank is increased by an amount corresponding to the return flow rate provided by the return pump, a flow speed required for carrying larger rock fragments can be ensured even with the pipe between the first open tank and the crusher increased in diameter to such an extent as allowing the larger rock fragments before being crushed to pass through it.

(13) In the above (11), preferably, an air purge pipe is connected to a suction pipe between the first open tank and the suction pump, and a vacuum pump for forcibly sucking and removing air in the carrying fluid flowing through the suction pipe is provided in the air purge pipe.

With that feature, the air mixed into the carrying fluid together with the earth is forcibly sucked and removed, and the suction pump can suck the carrying fluid in the first open tank without suffering a reduction in efficiency caused by mixing of air.

(14) In the above (2), preferably, the suction/discharge means comprises a flow divider having a closed tank to which the carrying fluid including the earth is delivered from the first open tank, and dividing the carrying fluid into a carrying fluid including gravel-like rock fragments in the earth and a carrying fluid including no gravel-like rock fragments, a discharge pump provided downstream of the flow divider for sucking and delivering under pressure the carrying fluid branched in the closed tank and including gravel-like rock fragments to the ground surface, and carrying fluid return means including a return pump for sucking and returning the carrying fluid branched in the closed tank and including no gravel-like rock fragments to the first open tank, the return pump and the discharge pump cooperatively sucking and discharging the carrying fluid in the first open tank together with the earth through the flow divider.

By so constructing the flow divider by the closed tank and providing the discharge pump and the return pump both downstream of the fluid divider, suction forces of the discharge pump and the return pump are transmitted to the first open tank through the flow divider. Therefore, the carrying fluid in the first open tank can be sucked and discharged together with the earth without providing any pump between the first open tank and the flow divider.

Also, by providing the carrying fluid return means, the flow rate supplied to the first open tank is replenished by the returned carrying fluid; hence the supply flow rate from the carrying fluid supply means can be reduced and the apparatus can be operated with better efficiency.

Further, since a flow rate of the carrying fluid delivered from the first open tank to the second open tank is increased by an amount corresponding to the return flow rate provided by the return pump, a flow speed required for carrying larger rock fragments can be ensured even with the pipe between the first open tank and the crusher increased in diameter to such an extent as allowing the larger rock fragments before being crushed to pass through it.

Additionally, since only the carrying fluid branched by the flow divider and including no gravel-like rock fragments is returned, the gravel-like rock fragments do not pass through a pipe line of the carrying fluid return means and a wear of the pipe line is remarkably reduced.

(15) In the above (14), preferably, a crusher for crushing the rock fragments included in the earth discharged along with the carrying fluid is provided between the first open tank and the flow divider.

With that feature, since the earth including rock fragments crushed by the crusher into smaller pieces are sent to the discharge pump, the carrying fluid including the earth can be smoothly delivered under pressure by the discharge pump.

(16) In the above (14), preferably, the flow divider includes a pipe member disposed in the closed tank for guiding the carrying fluid delivered from the first open tank and including the earth, and an opening is formed in a portion of the pipe member nearer to the discharge pump, the opening acting to divide the carrying fluid delivered from the first open tank and including the earth into a straight stream flowing straight toward the discharge pump and a rising stream flowing upward at a lower flow speed than the straight stream.

With that feature, the carrying fluid delivered from the first open tank and including the earth can be divided into the carrying fluid including gravel-like rock fragments and the carrying fluid including no gravel-like rock fragments.

(17) In the above (14), preferably, an air purge pipe is connected to an upper panel of the closed tank of the flow divider, and a vacuum pump for sucking and removing air accumulating in an upper space of the closed tank is provided in the air purge pipe.

By so purging out air with the flow divider, an amount of air mixed in the carrying fluid sucked from the flow divider by the discharge pump is reduced and the discharge pump can be operated with better efficiency.

(18) In the above (17), preferably, the air purge pipe extends to the first open tank and introduces air sucked by the vacuum pump to a position above a fluid surface in the first open tank.

With that feature, the carrying fluid sucked together upon purging-out of air can be returned to the first open tank without mixing air into the carrying fluid in the first open tank.

(19) In the above (11) or (14), preferably, the carrying fluid supply means includes a supply pipe connected to the first open tank, the suction/discharge means includes a suction pipe connected to the first open tank, the carrying fluid return means including a return pipe connected to the first open tank, and the first open tank comprises opposing sloped plates in pairs extending in the axial direction of the cutter disk and sloped to come closer to each other as they go down, and a bottom plate continuously joined to lower ends of the opposing sloped plates to define a bottom passage in the first open tank, the suction pipe having a suction port positioned at a rear end of the bottom passage, the supply pipe having a pouring port positioned at a front end of the bottom passage, the return pipe having a pouring port positioned obliquely toward the bottom passage at a level above the pouring port of the supply pipe.

With that feature, flowing forces of the carrying fluid ejected from the pouring port of the supply pipe are concentrated into the bottom passage so as to push the carrying fluid into the suction pipe, thus resulting in a greater earth carrying-out capability. Further, since the return pipe ejects the carrying fluid obliquely toward the bottom passage, a mass of gravel-like rock fragments and clayish earth can be more effectively collapsed and the formation of a bridge can be surely avoided.

In addition, since the excavated earth drops down to the bottom passage while sliding over the opposing sloped plates, the excavated earth can be smoothly discharged.

DESCRIPTION OF THE PREFERRED EMBODIMENTS

Embodiments of the present invention will be described hereunder with reference to the drawings.

To begin with, a first embodiment of the present invention will be described with reference to FIGS. 1–5.

Figure 1:
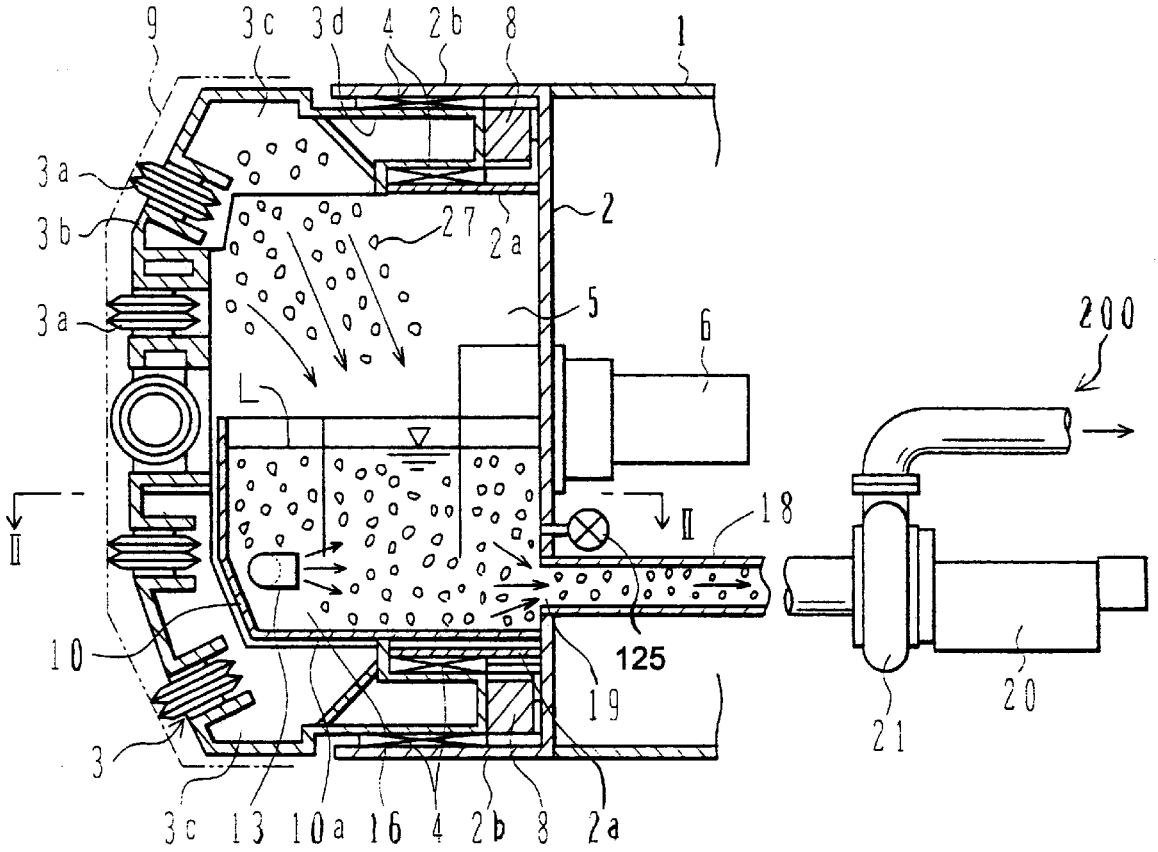
FIG. 1 is a side sectional view of principal part of a tunnel boring machine according to a first embodiment of the present invention.

In FIG. 1, a tunnel boring machine according to this embodiment includes a cylindrical boring machine body 1 constructed of steel materials. A partition wall 2 is provided at a fore end of the boring machine body 1, and concentric support frames 2*a*, 2*b* extend forward from the partition wall 2. A base portion 3*d* of a cutter disk 3 for digging into a working face 9 is rotatably attached between the support frames 2*a*, 2*b* through cutter seals 4, and a chamber 5 is formed between the partition wall 2 and the cutter disk 3. The cutter disk 3 has radial cutter frames 3*b* each including a plurality of cutters 3*a* attached thereto, and the cutter frames 3*b* are provided with respective buckets 3*c* for receiving earth 27 excavated by the cutters 3*a*.

Here, the term "earth" or "excavated earth" means a mass of earth produced by digging into the working face 9 with the cutters 3*a*. When digging into a rock bed as the ground having a non-disintegrative geological feature, a large part of the earth is in the form of rock fragments generated by digging into the rock bed. A 55% or more part of the rock fragments has a size not greater than 5×5×1.5 (cm). Also, the rock fragments include pieces having a maximum size of about 5×13×2 (cm), for example, which is determined depending on the spacing between two of the cutters 3*a* adjacent to each other, in a percentage of about 1–2%.

Figure 2:
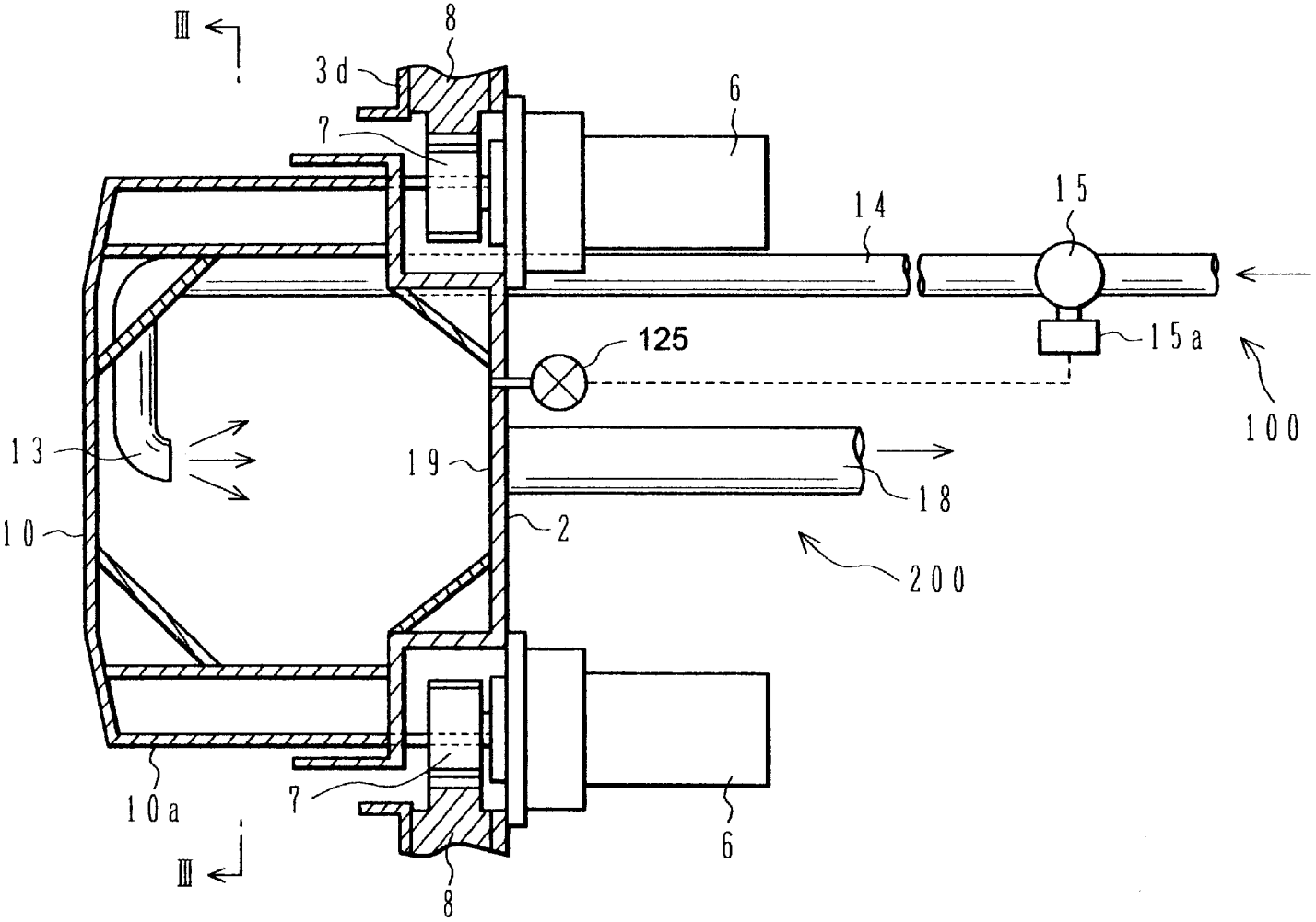
FIG. 2 is a sectional view taken along line II—II in FIG. 1.

As shown in FIG. 2, two hydraulic drive motors 6, 6 are attached to the partition wall 2 on both sides of the center thereof, and drive gears 7 coupled to rotary shafts of the hydraulic drive motors 6, 6 are meshed with an internal gear 8 attached to the base portion 3*d* of the cutter disk 3 in concentric relation. Upon rotation of the hydraulic drive motors 6, 6, the cutter disk 3 is rotated through the drive gear 7 and the internal gear 8.

In the chamber 5 formed between the cutter disk 3 and the partition wall 2, there is disposed an open tank 10 which serves also as a hopper for collecting the earth 27 excavated by the cutter disk 3. The open tank 10 is a container having a liquid-tight structure with the partition wall 2 constituting one of tank walls, and includes a tank body 10*a* which is liquid-tightly fixed to the partition wall 2 and has a semi-circular section (see FIG. 5(A)).

The open tank 10 is provided with a supply pipe 14 and a suction pipe 18. The supply pipe 14 supplies a carrying fluid (hereinafter also referred to simply as water) being mainly water and mixed with a small amount of solution of chemicals such as a gravity increasing agent, and the supplied water is sucked and discharged rearward together with the collected earth through the suction pipe 18.

The suction pipe 18 is attached to the partition wall 2 such that its suction port 19 is opened to a bottom portion of the open tank 10. The supply pipe 14 is attached such that it extends forward in the tank body 10*a* after penetrating a portion of the partition wall 2 on one side, and its pouring or entry port 13 is positioned below a lower limit of a variation in depth Δh (described later) of the water level in the open tank 10. Additionally, the supply pipe 14 is bent at 90° in a front portion of the tank body 10*a* and its distal end portion is bent at 90° again so that the poring port 13 is positioned to substantially face the suction port 19 of the suction pipe 18.

Figure 3:
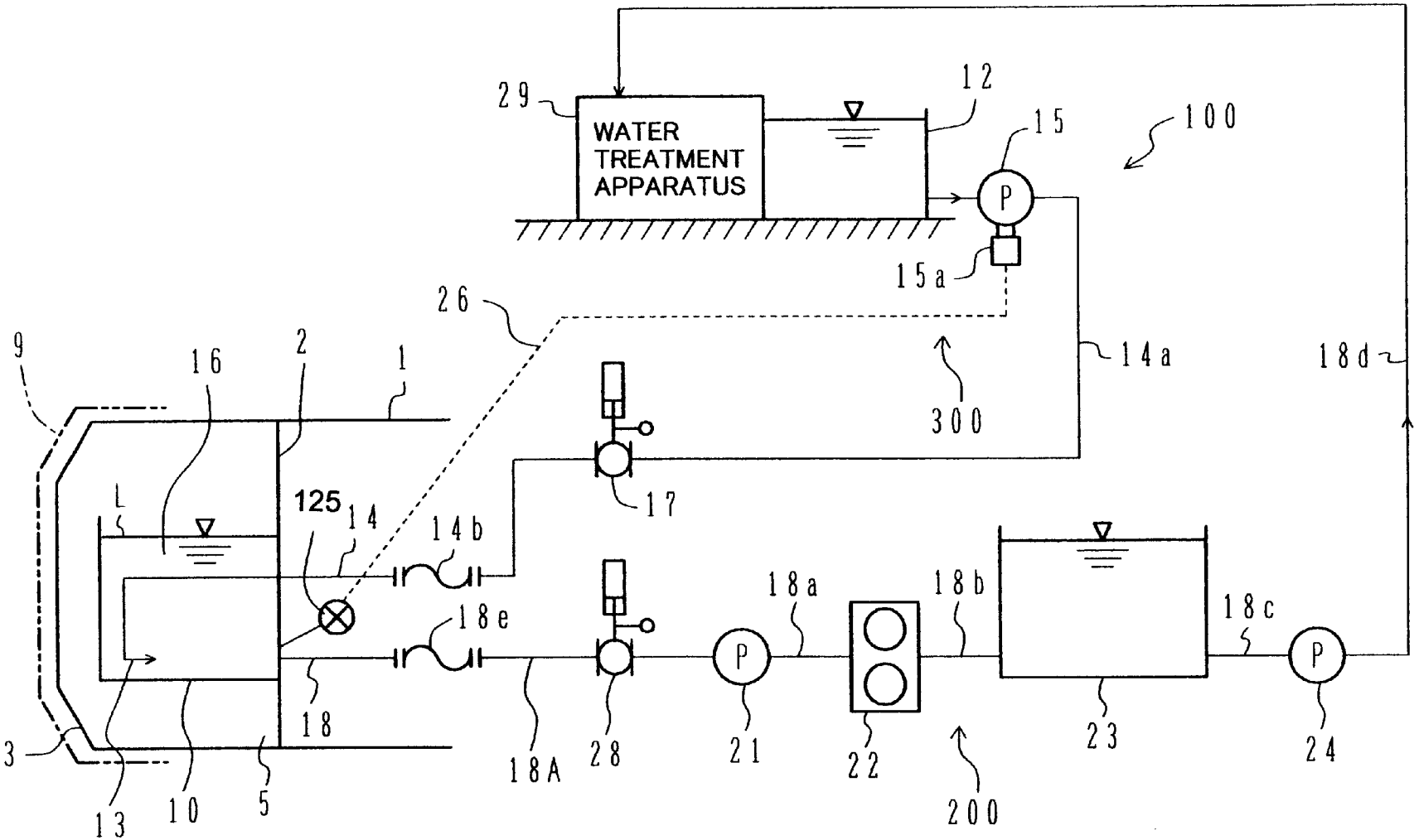
FIG. 3 is a diagram showing a carrying fluid supply/discharge system for the tunnel boring machine shown in FIG. 1.

FIG. 3 shows an entire supply/discharge system for the carrying fluid in relation to the supply pipe 14 and the suction pipe 18.

In FIG. 3, denoted by 100 is a carrying fluid supply system for supplying the carrying fluid (water) to the open tank 10, and 200 is a suction/discharge system for sucking and discharging the water in the open tank 10 together with the excavated earth.

The carrying fluid supply system 100 comprises a supply tank 12 installed on the ground surface and serving as a supply source for the carrying fluid (water), and a supply pump 15 for delivering under pressure the water in the supply tank 12 to the open tank 10. The supply tank 12 is connected to the open tank 10 through a supply pipe 14*a*, a hose 14*b* and the above-mentioned supply pipe 14. An opening/closing valve 17 is disposed in the supply pipe 14*a*.

The suction/discharge system 200 comprises a suction pump 21 for sucking the water in the open tank 10 together with the excavated earth, a crusher 22 for crushing the rock fragments included in the earth sucked along with the water, an open tank 23 for temporarily storing the water including the earth to make bubbles float up to the water surface for removal of air mixed in the water, and a discharge pump 24 for delivering under pressure the water in the open tank 23 to a water treatment apparatus 29. The suction pump 21 is connected to the open tank 10 through the above-mentioned suction pipe 18, a hose 18*e* and a suction pipe 18A. Downstream of the suction pump 21, the crusher 22, the open tank 23 and the discharge pump 24 are connected successively in this order through respective suction pipes 18*a*, 18*b*, 18*c*. The discharge pump 24 is connected to the water treatment apparatus 29 through a suction pipe 18*d*, and an opening/closing valve 28 is disposed in the suction pipe 18A.

The hoses 14*b*, 18*e* serve to absorb bending deformations of the supply pipes and the discharge pipes caused when the boring machine body 1 is changed in orientation for adjustment of the digging direction.

The supply pump 15 and the discharge pump 24 are each a centrifugal pump, particularly a volute pump, which is the same as employed for the slurry pressure technique. The suction pump 21 is one newly provided in the present invention, and also comprises a centrifugal pump, particularly a volute pump, in this embodiment. It was confirmed that by so using a volute pump as the suction pump, even when gravel-like rock fragments (the above-mentioned rock fragments having a maximum size of about 5×13×2 (cm)) before crushed by the crusher 22 are included in the suction pump 21, the water mixed with those rock fragments can be sucked and discharged efficiently, and the system can maintain a sufficient degree of durability.

The supply pump 15 and the suction pump 21 are provided with respective inverter motors, as their driving sources, capable of being controlled in rotational speed. FIG. 1 shows, by way of typical example, a state where an the suction pump 21 is provided with an inverter motor 20.

In association with the above carrying fluid supply system, there is provided a water level control system 300 for monitoring a water level in the open tank 10 and controlling the water level to be held constant. The water level control system 300 comprises a water-pressure gauge 125 provided in the partition wall 2, which is part of the walls of the open tank 10, for detecting a water pressure at the bottom of the open tank 10, and a controller 15*a* to which a detection signal of the water-pressure gauge 125 is sent via a signal cable 26 for control of the supply pump 15.

The water-pressure gauge 125 is provided as water level detecting means for detecting a water level in the open tank 10. The controller 15*a* estimates a water level in the open tank 10 from a detected value of the water-pressure gauge 125 by utilizing the fact that the water level is in proportion to the water pressure. Although a floating type sensor or the like may also be used as the water level detecting means, the use of the water-pressure gauge 125 is advantageous in that it includes essentially no moving parts, can be installed more easily, and is less likely to fail.

Further, the controller 15*a* determines, based on the estimated water level, such a supply amount (Qa/t) of the water supplied by the supply pump 15 per unit time as necessary for keeping constant the water level in the open tank 10, and controls a rotational speed of the inverter motor of the supply pump 15 so that the determined supply amount is obtained.

Figure 4:
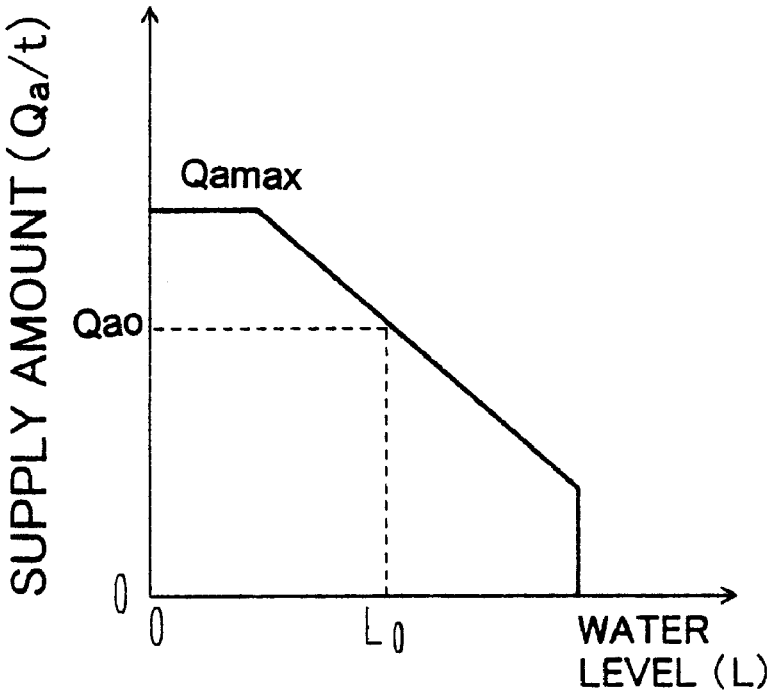
FIG. 4 is a graph showing the correlation between a water level and a supply amount in and to an open tank used in a water level control system shown in FIG. 3.

More specifically, the controller 15*a* stores therein the correlation between a water level L and a supply amount (Qa/t) per unit time as shown in FIG. 4, and determines the corresponding supply amount from the estimated water level L. Here, the correlation between the water level L and the supply amount (Qa/t) per unit time is such that the supply amount is increased as the water level L lowers down below a target water level Lo, and is reduced as the water level L rises up above the target water level Lo. Also, Qao represents a supply amount Qo which results when the water level L is at the target water level Lo, and is set to a flow rate corresponding to a target suction amount provided by the suction pump 21. Further, Qamax represents a supply amount corresponding to a maximum delivery rate of the supply pump 15.

A manner of determining the target water level Lo will now be described with reference to FIG. 5.

Figures 5A, 5B:
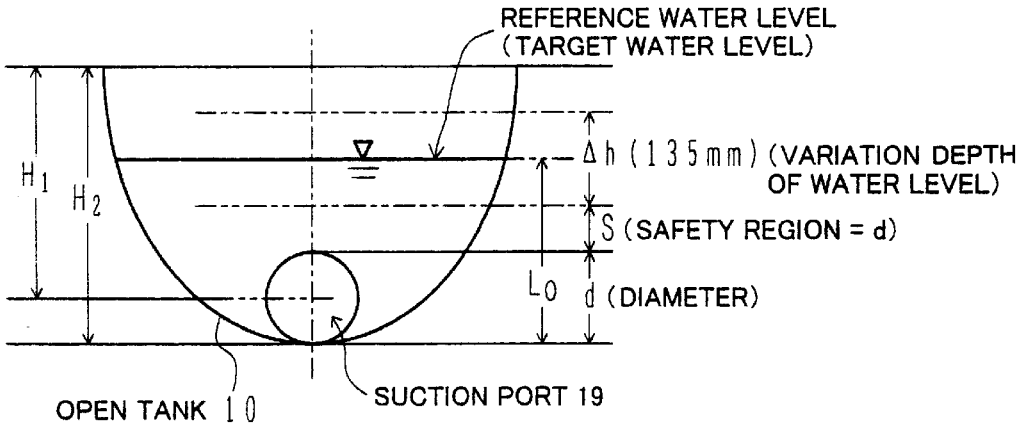
FIG. 5(A) is a graph representing the concept for determining a target water level in water level control.
FIG. 5(B) shows experimental data about a variation depth of the water level as one of factors used when determining the target water level.

FIG. 5(A) schematically shows a cross-section of the open tank 10 which serves also as a hopper. In FIG. 5(A), d is the diameter of the suction port 19 of the suction pipe 18, Δh is the variation width of the water level attributable to the water level control system 300, S is the height of a safety region, H1 is the minimum height of the open tank 10 measured from the center of the suction port 19, and H2 is the minimum overall height of the open tank 10.

In the present invention, the target water level Lo is determined from the following formula in consideration of the variation width Δh of the water level attributable to the water level control system 300 and the height S of the safety region:

$$Lo \geqq d+S+(\Delta h/2)$$

$$S=d$$

Accordingly, $$Lo \geqq 2d+(\Delta h/2)$$

Hence, when determining the target water level Lo, the variation depth Δh of the water level attributable to the water level control system 300 is first taken into consideration.

Here, the water sucked from the open tank 10 acts to discharge the earth excavated and collected in the open tank 10. Because an amount of the excavated earth is increased as a digging speed of the tunnel boring machine rises, a suction/discharge flow rate of the water is required to be increased correspondingly. If the suction/discharge flow rate increases, the supply amount of the water must also be increased to keep the water level constant. Because of a response delay in control of the water level control system 300, the variation depth Δh of the water level is also enlarged with an increase in the supply amount of the water. To prevent the water level from lowering down below an upper end of the suction port 19, the variation depth Δh of the water level must be set so that its lower limit will not lower down below the upper end of the suction port 19.

Thus, the variation depth Δh of the water level is a value depending on the supply amount, the suction/discharge amount, the time constant (response in control process), and so on. In the present invention, a value confirmed by actual experiments is used as the variation depth Δh of the water level.

Should the water level lower down below the upper end of the suction port 19, the suction pump 21 would be rotated idly and could no longer suck the water because of a failure in the siphonage. For this reason, the safety region is further taken into consideration in the present invention. Since the variation depth Δh of the water level is enlarged upon an increase in the suction/discharge amount of the water as stated above, the height S of the safety region is preferably set to a larger value. An increase in the suction/discharge amount of the water makes it necessary to use the suction pipe 18 having a larger diameter, which in turn increases the diameter d of the suction port 19. In the present invention, therefore, the height S of the safety region is determined in relation to the diameter d of the suction port 19 and set to a value at least equal to d.

If the target water level Lo is determined, the minimum heights H1, H2 of the open tank 10 are determined from the following formulae:

$$H1=(d/2)+S+\Delta h=(3d/2)+\Delta h$$

$$H2=d+S+\Delta h=2d+\Delta h$$

Experimental values are shown below.

On condition that the open tank 10 used in the experiments has a size fit for the case where the open tank 10 is assumed to be installed in the tunnel boring machine having a diameter of 2.3 m, and the diameter d of the suction port 19 is 150 mm (6 inches), the variation depth of the water level, shown in FIG. 5(B), was obtained with respect to respective digging speeds as a result of measuring the variation depth of the water level while changing the digging speed. Taking into account that an average value of digging speeds of general tunnel boring machines is 7 cm/min, the variation width 135 mm of the water level at the digging speed of 7 cm/min was set as the aforesaid Δh based on the obtained data.

From the above, the minimum target water level Lo is given by:

$$Lo=2d+(\Delta h/2)$$

$$=2\times150+(135/2)=367.5\ (mm)$$

Also, the minimum overall height H2 of the open tank 10 is given by:

$$H2=2d+\Delta h$$

$$=2\times150+135=435\ (mm)$$

The operation of this embodiment thus constructed will be described below. First, the opening/closing valve 17 is opened and the supply pump 15 is started to rotate, causing the water in the supply tank 12 to be supplied to the open tank 10 through the supply pipes 14*a*, 14. The water supplied to the open tank 10 is denoted by reference numeral 16. When the water 16 is pooled in the open tank 10 and the water level L in the open tank 10 rises to some extent, the opening/closing valve 28 is opened and the inverter motor 20 is operated to rotate the suction pump 21.

In such a condition, the cutter disk 3 is rotated by the drive motor 6 to dig into the working face 9 by the cutters 3*a*. At this time, the excavated earth 27 rests in the buckets 3*c* and then cyclically drops into the open tank 10 upon the rotation of the cutter disk 3, thereby being accumulated therein. The accumulated earth 27 is sucked along with the water 16 by the suction pump 21 through the suction port 19 of the suction pipe 18 and then carried to the crusher 22 through the discharge pipe 18*a* after passing the suction pipes 18, 18A and the suction pump 21. The crusher 22 crushes gravel-like rock fragments included in the earth 27, and a mixture of the earth and the water including the crushed smaller rock fragments are sent to the open tank 23. In the open tank 23, air contained in the water ascends in the form of bubbles to the water surface for purging of the air, and the water free from air is delivered under pressure together with the earth by the discharge pump 24 to the water treatment apparatus 29 on the ground surface.

When sucking and discharging the earth from the open tank 10 along with the water as explained above, if the water level L of the water 16 in the open tank 10 is lowered because of unbalance among the amount of the earth 27 excavated and accumulated in the open tank 10, the supply amount of the water to the open tank 10, and the suction/discharge amount of the water 16 from the open tank 10 to such an extent that a large amount of air is sucked into the suction pipe 18, the suction pump 21 would be rotated idly and could no longer suck the water 16. In this embodiment, since the water pressure in the open tank 10 is detected, the water level L in the open tank 10 is estimated from the detected value, and the supply amount is controlled to maintain the water level L at the target water level Lo, as explained above, the suction pump 21 is surely prevented from rotating idly due to a lowering of the water level.

Also, since the suction/discharge amount of the water is determined by the suction pump 21, the suction/discharge amount can be easily increased and an earth carrying-out capability can be made greater than the case of using a jet pump.

Further, since the pouring port 13 of the supply pipe 14 is positioned below the lower limit of the variation depth Δh of the water level, the pouring port 13 will never be exposed to open air. Therefore, air is not mixed in the water 16 in the open tank 10 when the water is poured from the supply pipe 14 into the open tank 10, and air is mixed in the water 16 only when the excavated earth is dropped into the open tank 10 from the buckets 3*c*. Accordingly, an amount of air mixed in the water 16 can be minimized and the suction pump 21 can suck and discharge the water 16 and the earth 27 while minimizing a reduction in efficiency caused by mixing of air in the water 16.

Moreover, since the suction pump 21 is disposed upstream of the crusher 22, the length of the suction pipes 18, 18A connecting the open tank 10 and the suction pump 21 to each other can be so shortened that in spite of air being mixed in the water upon the earth dropping into the open tank 10, the suction pump 21 can continue the suction and discharge of the water without causing a significant reduction in efficiency. In addition, since a pressure drop due to resistance of the flow passage is minimized, it is also possible to minimize cavitation that is possibly occurred upon air in the water turning to bubbles under a pressure drop.

Furthermore, since the earth including the rock fragments crushed by the crusher 22 into smaller rock fragments is sent to the discharge pump 24 and air mixed in the water is purged out in the open tank 23, the discharge pump 24 can smoothly deliver the earth under pressure without causing a reduction in efficiency caused by air mixed in the water.

With this embodiment, as explained above, since the water in the open tank is sucked and discharged together with the excavated earth by the suction pump 21 while maintaining the proper water level in the open tank 10, it is possible to prevent clogging due to small stones or the like that has been experienced in such a small-diameter nozzle as of a jet pump, and to discharge the earth 27 smoothly and continuously. As a result, interruption of the boring work is reduced, the problems incidental to the interruption of the boring work, i.e., need of more labor and extension of the term of works, are eliminated, and a reduction in the term of works and the construction cost can be achieved.

When using a jet pump, its application is limited to tunnel boring machines having a small diameter because of a carrying function specific to the jet pump. On the other hand, with this embodiment, the earth carrying-out capability can be easily increased by control of the supply amount and the suction/discharge amount, and the application field can be made broader to cover tunnel boring machines ranging from a small diameter to a medium diameter. Further, the broader application field can eliminate the need of changing the working method depending on the machine diameter.

Additionally, since no nozzle is employed unlike the case of using a jet pump, the lower portion of the open tank 10 is avoided from having a complicated structure.

It is to be noted that while the crusher 22 is disposed downstream of the suction pump 21 in this embodiment, the crusher 22 may be disposed upstream of the suction pump 21. In this case, the earth having been crushed by the crusher 22 is sent to the suction pump 21, and therefore the earth can be more smoothly sucked by the suction pump 21.

A second embodiment of the present invention will be described with reference to FIGS. 6 and 7. In these drawings, equivalent members to those shown in FIG. 3 are denoted by the same reference numerals and will not be explained here.

Figure 6:
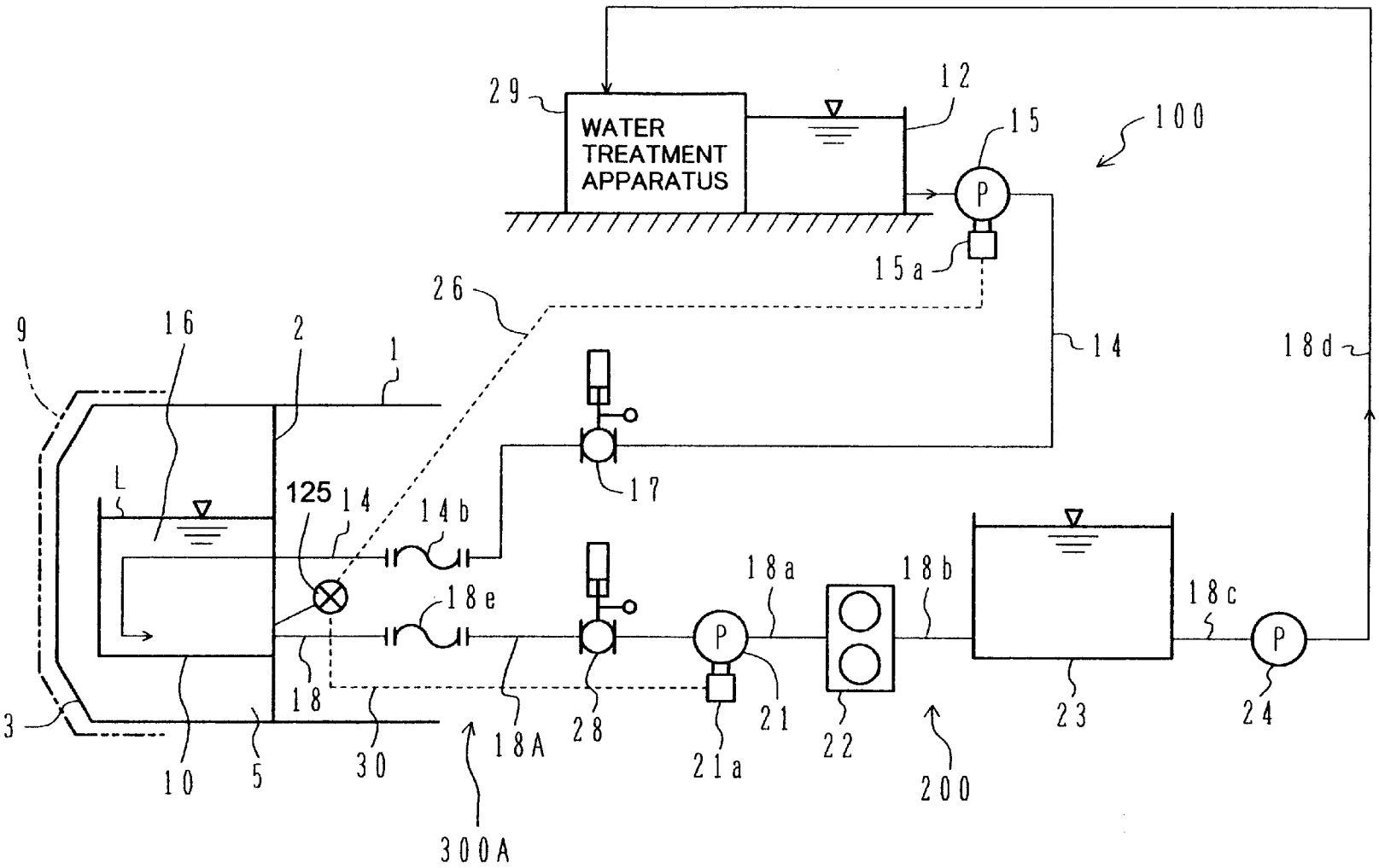
FIG. 6 is a diagram showing a carrying fluid supply/discharge system for a tunnel boring machine according to a second embodiment of the present invention.

Referring to FIG. 6, a water level control system 300A provided in a tunnel boring machine of this embodiment includes, in addition to the water-pressure gauge 125 and the controller 15*a* for the supply pump 15, a controller 21*a* for the suction pump 21. The detection signal of the water-pressure gauge 125 is sent via a signal cable 30 to the controller 21*a* as well. The controller 21*a* estimates a water level in the open tank 10 from a detected value of the water-pressure gauge 25 and determines, based on the estimated water level, such a suction amount (Qb/t) of the water sucked by the suction pump 21 per unit time as necessary for keeping constant the water level in the open tank 10, and controls a rotational speed of the inverter motor 20 (see FIG. 1) of the suction pump 21 so that the determined suction amount is obtained.

Figure 7:
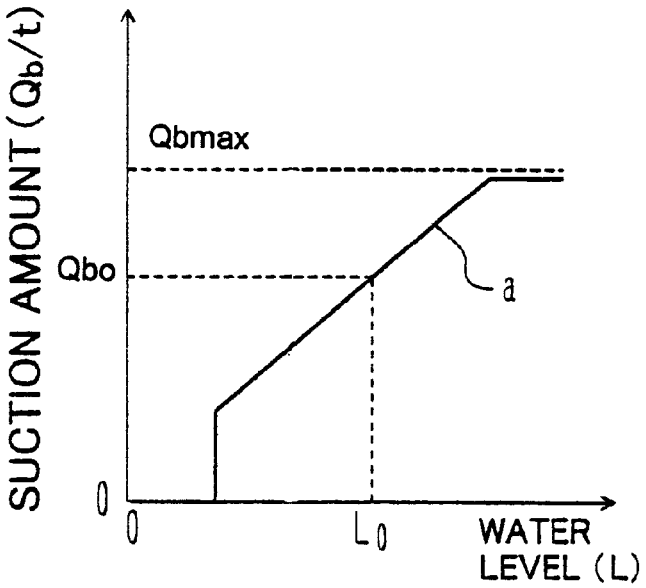
FIG. 7 is a graph showing the correlation between a water level and a discharge amount in and from an open tank used in a water level control system shown in FIG. 6.

More specifically, the controller 21*a* stores therein the correlation between a water level L and a suction amount (Qb/t) per unit time as indicated by a solid line a in FIG. 7, and determines the corresponding suction amount from the estimated water level L. Here, the correlation between the water level L and the suction amount (Qb/t) per unit time is such that the suction amount is reduced as the water level L lowers down below a target water level Lo, and is increased as the water level L rises up above the target water level Lo. Also, Qbo represents a target suction amount provided by the suction pump 21 and Qbmax represents a suction amount corresponding to a maximum delivery rate of the supply pump 15.

With this embodiment, since the water level L in the open tank 10 is maintained at the target water level Lo by controlling not only the supply amount of the water to the open tank 10, but also the suction/discharge amount of the water from the open tank 10, the water level control can be performed with better response.

A third embodiment of the present invention will be described with reference to FIGS. 8 to 11. In these drawings, equivalent members to those shown in FIGS. 1 to 3 are denoted by the same reference numerals and will not be explained here.

Figure 8:
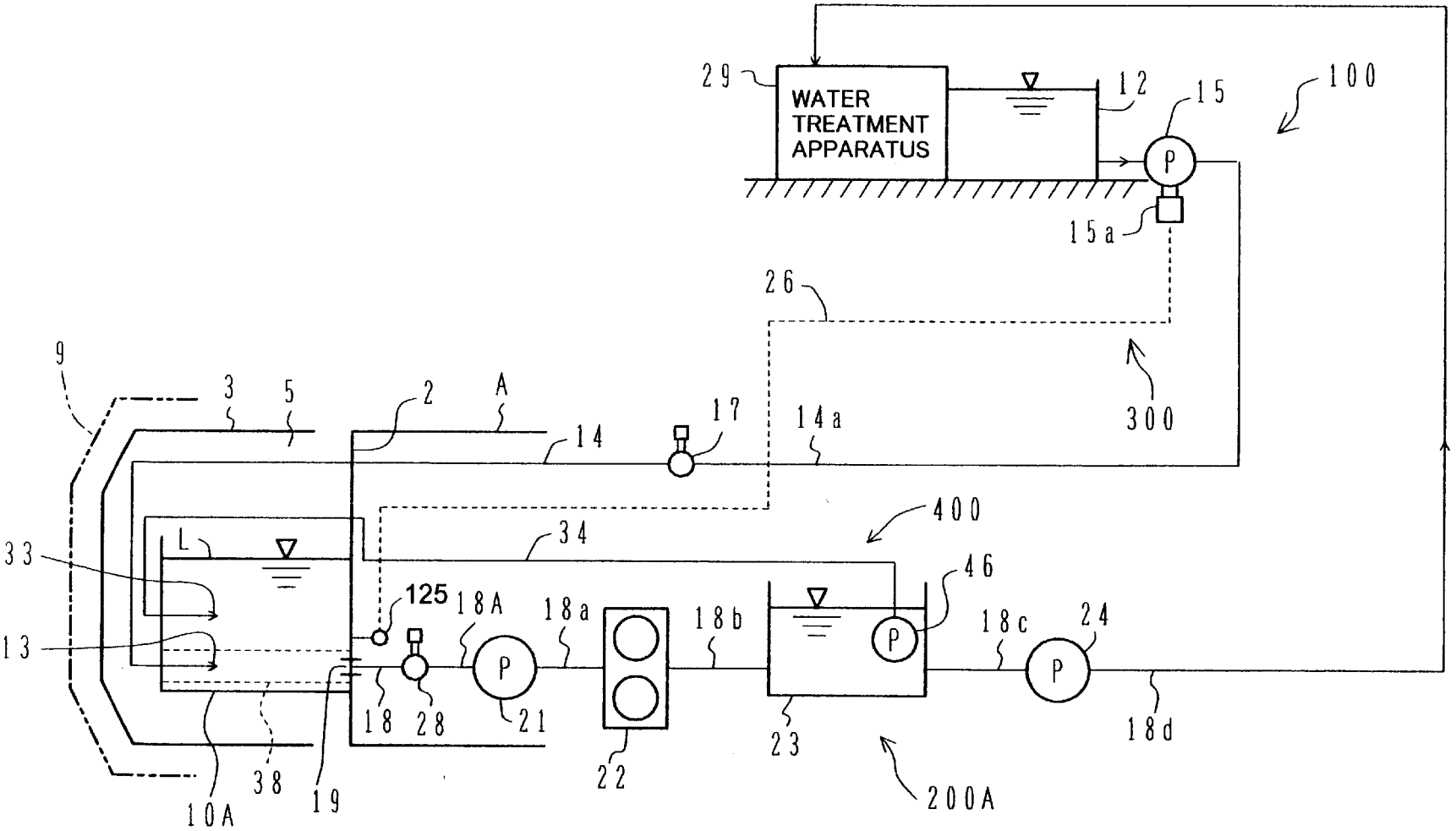
FIG. 8 is a diagram showing a carrying fluid supply/discharge system for a tunnel boring machine according to a third embodiment of the present invention.

Referring to FIG. 8, a tunnel boring machine of this embodiment includes an open tank 10A instead of the open tank 10 in FIG. 1, a suction/discharge system 200A instead of the suction/discharge system 200, and a carrying fluid return system 400 for returning part of the water having been discharged to the open tank 23 by the suction/discharge system 200A to the open tank 10A again is associated with the open tank 10A in addition to the carrying fluid supply system 100, the suction/discharge system 200A and the water level control system 300.

The carrying fluid return system 400 comprises a return pump 46 of the volute type which is one of centrifugal pumps and immersed in the water in the open tank 23, and a return pipe 34 allowing the water including no gravel-like earth, that is sucked by the return pump 46, to be returned to the open tank 10A through it.

In the suction/discharge system 200A, the suction pipes 18, 18A and the discharge pipe 18*a* interconnecting the open tank 10A and the crusher 22 each have a greater diameter than the discharge pipes 18*b*–18*d* downstream of the crusher 22 so that larger rock fragments before being crushed by the crusher 22 can pass the former pipes. Note that the hoses 14*b*, 18*e* shown in FIG. 1 are omitted.

Further, the suction pump 21 provides a suction flow rate set to be greater than a delivery flow rate provided by the discharge pump 24, and the return pump 46 provides a return flow rate set to be substantially equal to a differential flow rate between the suction flow rate provided by the suction pump 21 and the delivery flow rate provided by the discharge pump 24.

Figure 9:
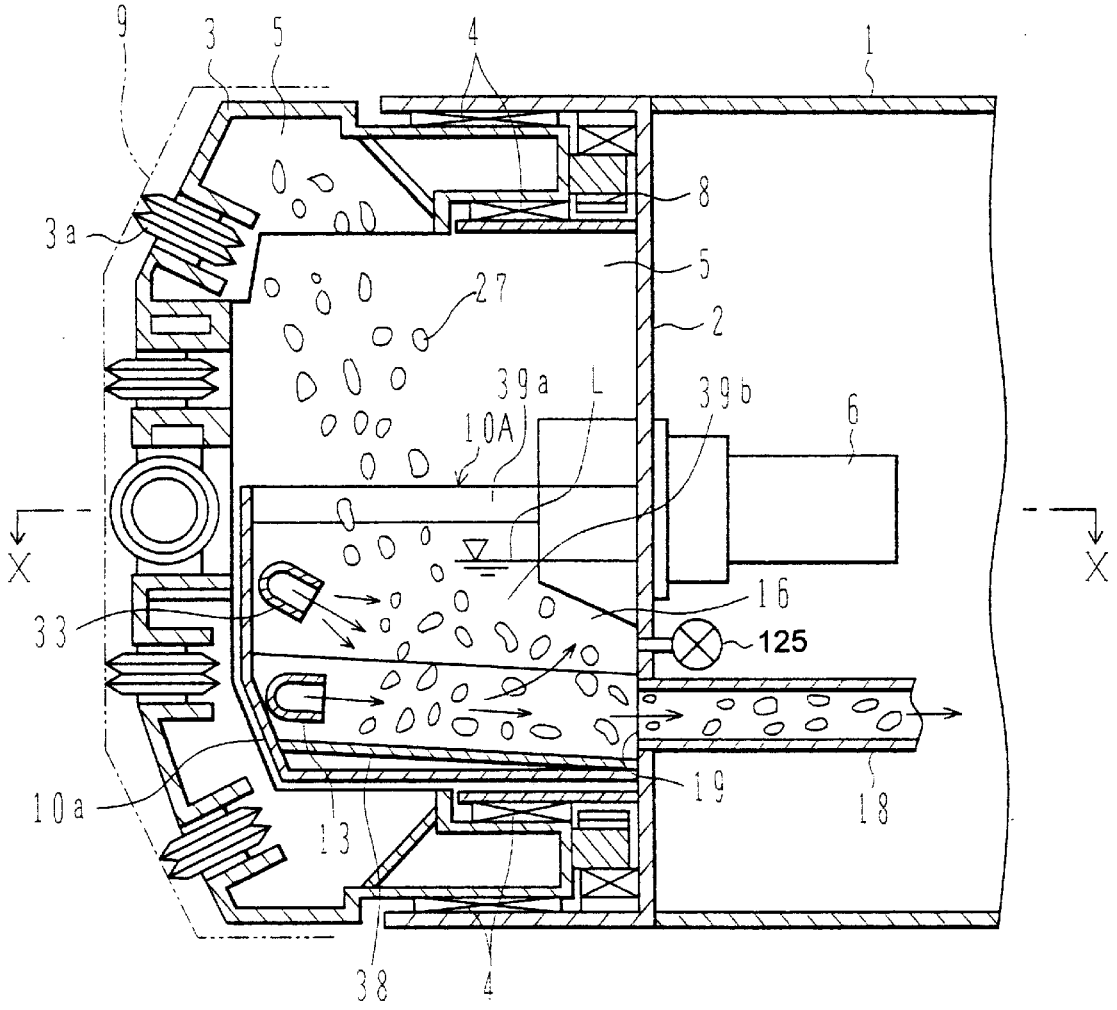
FIG. 9 is a side sectional view of principal part of the tunnel boring machine shown in FIG. 8.
Figure 10:
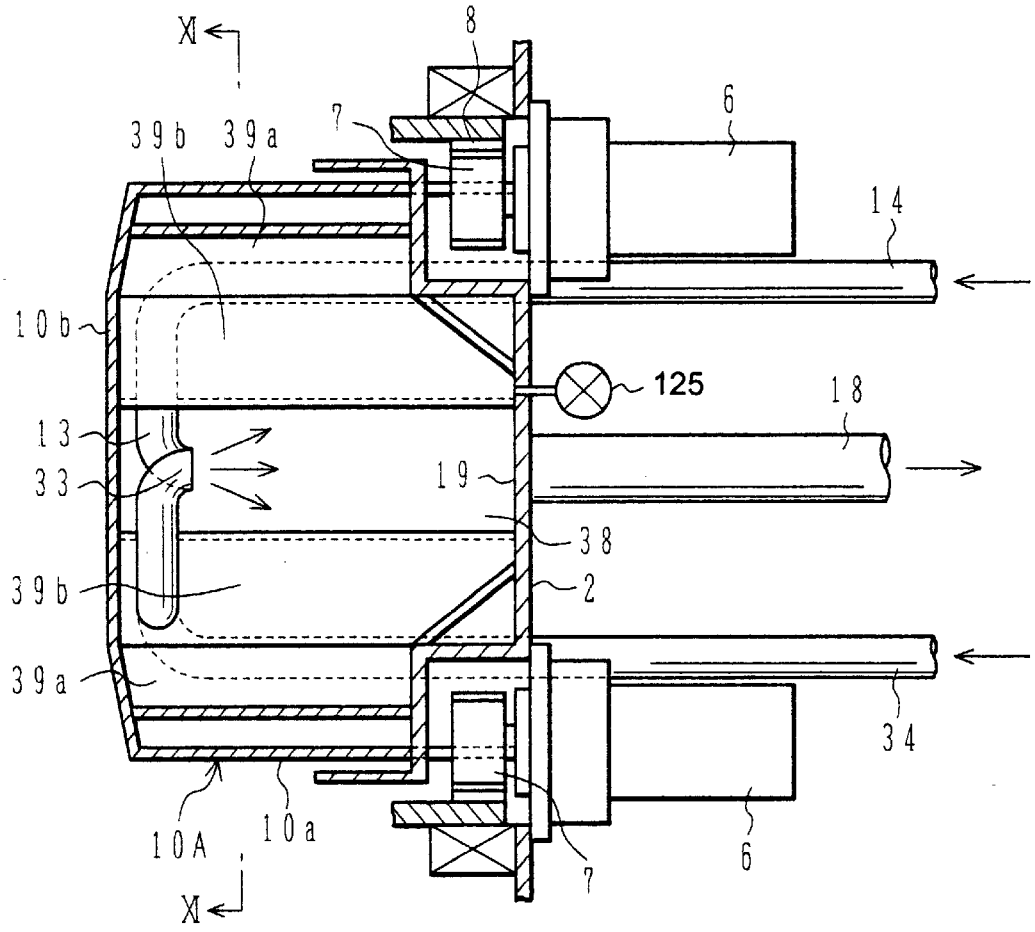
FIG. 10 is a sectional view taken along line X—X in FIG. 9.
Figure 11:
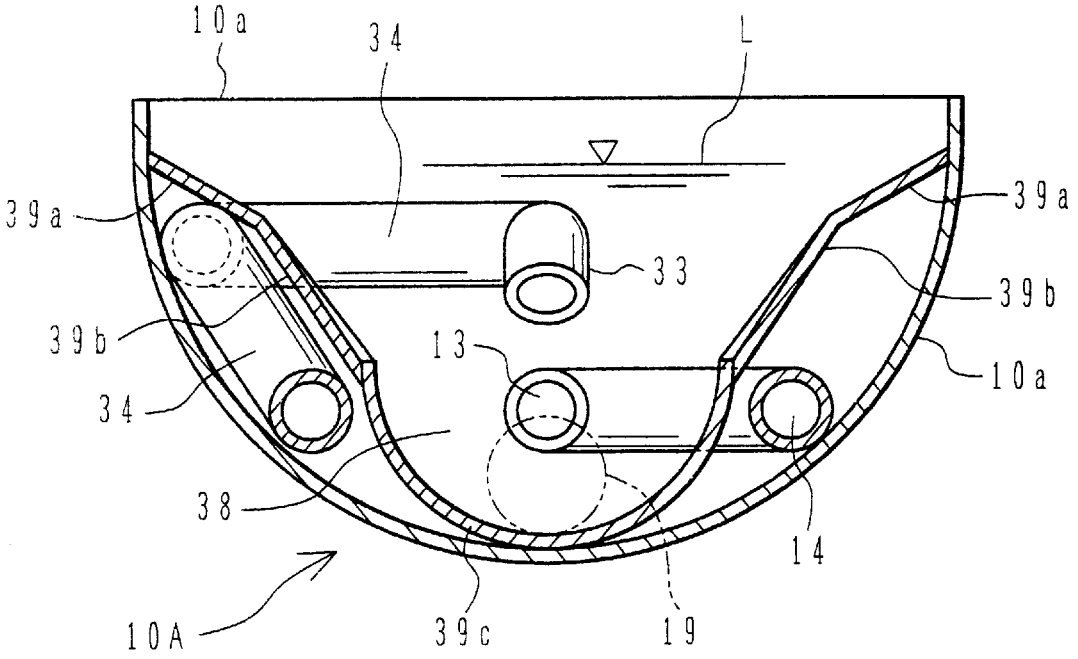
FIG. 11 is a sectional view taken along line XI—XI in FIG. 10.

The detailed structure of the open tank 10A is shown in FIGS. 9–11. The open tank 10A includes a tank body 10*a* which is liquid-tightly fixed to the partition wall 2 and has a semicircular section. Inside the tank body 10*a* between the partition wall 2 and a front wall 10*b* of the tank body 10*a*, there are disposed upper sloped guide plates 39*a*, 39*a* and lower sloped guide plates 39*b*, 39*b* in pairs extending in the axial direction of the cutter disk 3 and sloped to come closer to each other as they go down, and a curved bottom plate 39*c* continuously joined to lower ends of the lower sloped guide plates 39*b*, 39*b* to define a bottom passage 38. The sloped guide plates 39*a*, 39*a*; 39*b*, 39*b* guide the excavated earth 27 dropped into the open tank 10A to the bottom passage 38, and the bottom passage 38 enables the accumulated earth 27 to be more easily discharged along with the water. Further, the lower sloped guide plates 39*b*, 39*b* have lower edges fixedly welded to upper edges of the curved bottom plate 39*c*, and the upper sloped guide plates 39*a*, 39*a* have lower and upper edges fixedly welded respectively to upper edges of the lower sloped guide plates 39*b* and inner wall upper portions of the tank body 10*a*.

While the sloped guide plates 39*a*, 39*b* and the curved bottom plate 39*c* are provided as separate members from the tank body 10*a* in this embodiment, the structure may be modified such that outer walls of the open tank 10A are directly constructed of the sloped guide plates 39*a*, 39*b* and the curved bottom plate 39*c*.

In addition, the suction pipe 18 is attached to the partition wall 2 such that the suction port 19 is positioned at a rear end of the bottom passage 38. The supply pipe 14 is attached such that after penetrating a portion of the partition wall 2 on one side, it extends forward between the tank body 10*a* and the curved bottom plate 39*c*, is bent at 90° in a front portion of the tank body 10*a* to penetrate the curved bottom plate 39*c*, and then comes into the bottom passage 38. Further, a distal end portion of the supply pipe 14 is bent at 90° again so that the poring port 13 is positioned at a front end of the bottom passage 38 to substantially face the suction port 19 of the suction pipe 18. The return pipe 34 is attached such that after penetrating a portion of the partition wall 2 on one side, it extends forward between the tank body 10*a* and the bottom passage 38, is bent twice at 90° upward in its intermediate portion to rise up to a higher level, following which it is bent in the front portion of the tank body 10*a* to penetrate the sloped guide plates 39*a*, 39*b* and then comes into a space between the sloped guide plates 39*a*, 39*b*. Further, a distal end portion of the return pipe 34 is bent at 90° again so that a pouring or exit port 33 is positioned obliquely relative to the suction pipe 18 toward a portion of the bottom passage 38 near the suction port 19 of the suction pipe 18 at a level above the pouring port 13 of the supply pipe 14. Thus, the pouring or exit port 33 is located so as to agitate the earth by ejecting water toward the bottom passage 38 from an intermediate or upper portion of the open tank 10A.

In this embodiment thus constructed, water is supplied to the open tank 10A through the pouring port 13 of the supply pipe 14, and the earth 27 accumulated in the open tank 10A is sucked along with the water 16 by a suction force of the suction pump 21 through the suction port 19 of the suction pipe 18 and then passes the suction pump 21 through the suction pipes 18, 18A, followed by being fragmented by the crusher 22 and sent to the open tank 23, as with the first embodiment. The water from which air has been purged out in the open tank 23 is delivered under pressure together with the earth by the discharge pump 24 to the water treatment apparatus 29 on the ground surface. Also, the water pooled in the open tank 23 and including no gravel-like earth is sucked by the return pump 46 and is returned to the open tank 10A through the return pipe 34.

When sucking and discharging the earth from the open tank 10A along with the water in such a way, as explained above in connection with the first embodiment, the controller 15*a* for the supply pump 15 estimates a water level L in the open tank 10A from a detected value of the water-pressure gauge 125 and controls the supply amount of the water so that the water level L is maintained at the target water level Lo. Therefore, the suction pump 21 is surely prevented from rotating idly due to a lowering of the water level.

The control of the water level L may be performed by controlling both the supply pump 15 and the suction pump 21 as explained above in connection with the second embodiment. As an alternative, the water level L may be controlled by regulating an amount of the water returned by the return pump 46 from the open tank 23, or bypassing part of the water flowing through the return pipe 34 and regulating an amount of the bypassed water.

Moreover, when returning part of the water in the open tank 23 to the open tank 10A, as explained above, the return flow rate provided by the return pump 46 is set to be substantially equal to a differential flow rate between the suction flow rate provided by the suction pump 21 and the delivery flow rate provided by the discharge pump 24. Therefore, the flow rate flowing into the open tank 23 is balanced by the flow rate flowing out of the open tank 23 and the water level in the open tank 23 is kept constant.

Since the suction flow rate provided by the suction pump 21 is given as the sum of the delivery flow rate provided by the discharge pump 24 and the return flow rate provided by the return pump 46, a large value can be ensured as the suction flow rate.

Here, the suction pipes 18, 18A and the discharge pipe 18*a* upstream of the crusher 22 each have a diameter so increased that larger rock fragments before being crushed by the crusher 22 can pass those pipes, as stated above. Also, a certain flow speed (e.g., 3 m/sec or more) is required to carry the larger rock fragments before being crushed without making them stagnant in the suction pipes 18, 18A and the discharge pipe 18*a*. In this embodiment, since the suction flow rate provided by the suction pump 21 can be set to a larger value corresponding to the sum of the delivery flow rate provided by the discharge pump 24 and the return flow rate provided by the return pump 46, a flow speed required for carrying the larger rock fragments can be ensured even with the suction pipes 18, 18A and the discharge pipe 18*a* increased in diameter.

Since part of the water in the open tank 23 is returned to the open tank 10A by the return pump 46, the supply amount of the water to the open tank 10A is replenished by the returned water, resulting in that the supply flow rate of the water from the supply tank 12 on the ground surface can be saved and the system can be operated with better efficiency.

Furthermore, in this embodiment, when the excavated earth 27 drops into the open tank 10A, the sloped guide plates 39*a*, 39*b* act to facilitate drop of the earth to the bottom passage 38 and facilitate discharge of the excavated earth 27 from the open tank 10A. The earth accumulated in the bottom passage 38 is pushed into the suction port 19 by not only the flowing force caused upon the suction pump 21 sucking the water, but also the flowing force of the water ejected from the pouring port 13 of the supply pipe 14. In addition, the flowing force of the water ejected from the pouring port 33 of the return pipe 34 further acts to push the earth into the suction port 19. Because such pushing actions take place in the curved bottom passage 38, those flowing forces are concentrated into a large resultant force.

Accordingly, a great earth carrying-out capability can be developed and the earth can be surely and efficiently discharged even when the earth includes relatively large gravel-like rock fragments.

In the case of the excavated earth 27 being in the form of gravel-like rock fragments and clayish earth, lumps of the earth dropped to the bottom of the open tank 10A may form a bridge while supporting each other. If such a bridge is formed at the bottom of the open tank 10A, the earth can no longer be sucked and discharged effectively.

In this embodiment, when a bridge is going to be formed in the bottom passage 38, a mass of rock fragments forming the bridge is collapsed by the flowing forces of the water ejected from the pouring port 13 of the supply pipe 14 and the pouring port 33 of the return pipe 34. As a result, the earth can be discharged without causing the bridging phenomenon.

Particularly, since the pouring port 33 of the return pipe 34 is positioned obliquely toward a portion of the bottom passage 38 near the suction port 19 of the suction pipe 18 at a level above the pouring port 13 of the supply pipe 14, the water is ejected to an area at a level where the bridging phenomenon is more likely to occur, thereby agitating the excavated earth. It therefore will collapse a mass of rock fragments going to form the bridge and to surely avoid the occurrence of the bridging phenomenon.

Respective amounts of the water ejected from the pouring port 13 of the supply pipe 14 and the pouring port 33 of the return pipe 34 can be changed as required depending on properties of the earth to be excavated. An effect of agitating the earth in the digging operation can be enhanced by, for example, increasing the amount of the water ejected from the pouring port 13 of the supply pipe 14 in a lower position when digging in a hard rock layer, and increasing the amount of the water ejected from the pouring port 33 of the return pipe 34 in an upper position when digging in a layer which is relatively soft and contains clayish earth.

While the pouring port 33 of the return pipe 34 is positioned right above the pouring port 13 of the supply pipe 14 in this embodiment, the pouring port 33 of the return pipe 34 may be disposed in an upper left or right portion of the open tank 10A to be open toward the bottom passage 38. Further, in this embodiment, the pouring port 13 of the supply pipe 14 is positioned to face the suction port 19 of the suction pipe 18 and the pouring port 33 of the return pipe 34 is positioned above the pouring port 13 of the supply pipe 14. Alternatively the pouring port 33 of the return pipe 34 may be positioned to face the suction port 19 of the suction pipe 18 and the pouring port 13 of the supply pipe 14 may be positioned above the pouring port 13 of the supply pipe 14.

In the case of the return pipe 34 being not provided unlike this embodiment, the supply pipe 14 may be branched in its intermediate portion such that one pipe is positioned to be open to face the suction port 19 of the suction pipe 18 and the other pipe is positioned obliquely relative to the suction pipe 18 to be open at a level above the pouring port 13 of the supply pipe 14.

Further, in the case of the return pipe 34 not provided unlike this embodiment, it is also possible to increase the earth carrying-out capability and avoid the bridging phenomenon to some extent by positioning only the pouring port 13 of the supply pipe 14 to face the suction port 19 of the suction pipe 18 in a rear end portion of the bottom passage 38.

A fourth embodiment of the present invention will be described with reference to FIG. 12. In the drawing, equivalent members to those shown in FIGS. 3 and 8 are denoted by the same reference numerals and will not be explained here.

Figure 12:
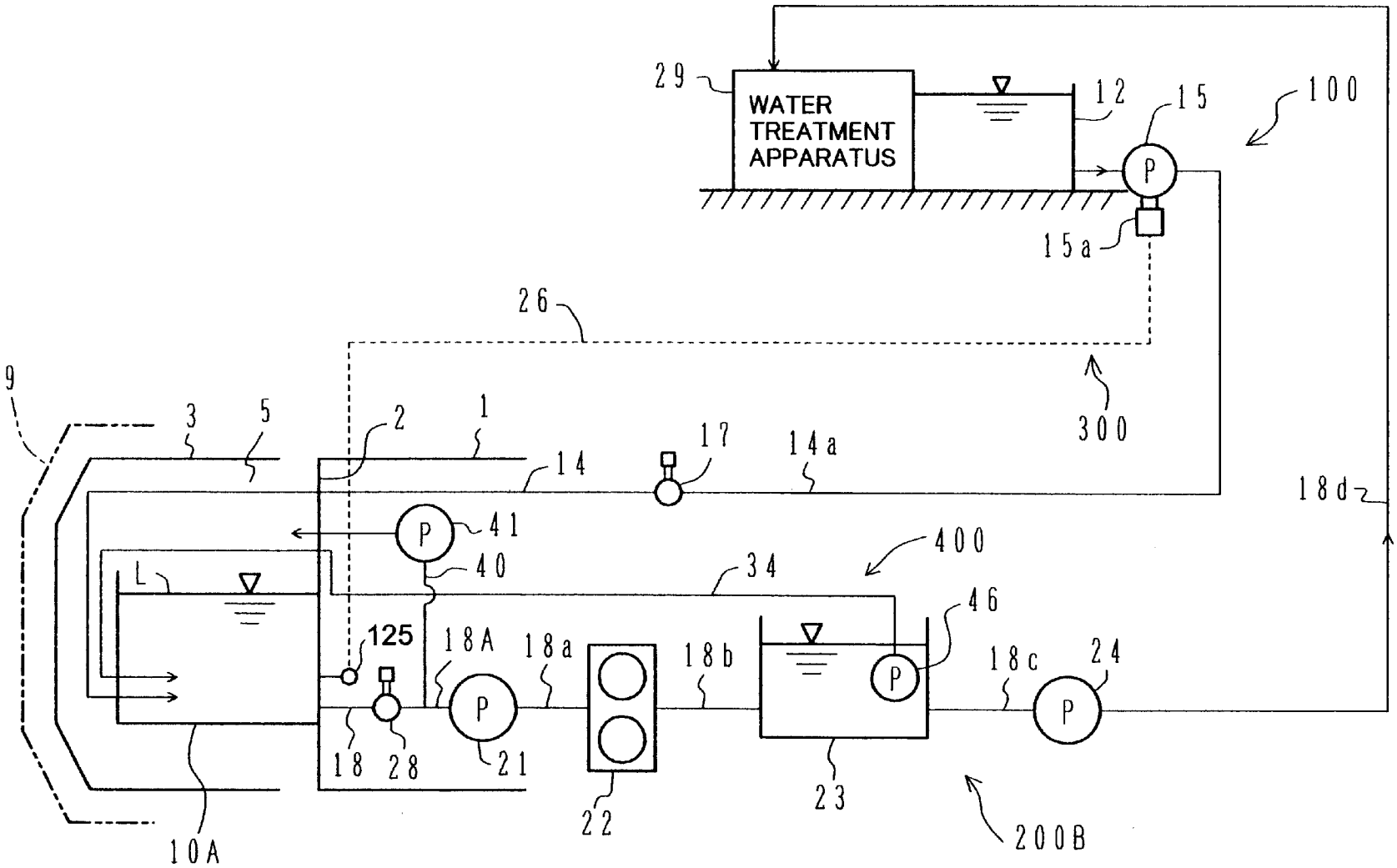
FIG. 12 is a diagram showing a carrying fluid supply/discharge system for a tunnel boring machine according to a fourth embodiment of the present invention.

Referring to FIG. 12, a suction/discharge system 200B installed in a tunnel boring machine of this embodiment includes an air purge pipe 40 connected to the suction pipe 18A between the opening/closing valve 28 and the suction pump 21, and a vacuum pump 41 provided in the air purge pipe 40 for forcibly sucking and removing air in the water flowing through the suction pipe 18A. The remaining construction is the same as shown in FIG. 8.

In this embodiment, since air in the water flowing through the suction pipe 18A is forcibly sucked and removed by the vacuum pump 41, the suction pump 21 can continue sucking the water without suffering from a reduction in efficiency caused by mixing of air in the water, resulting in a greater earth carrying-out capability.

A fifth embodiment of the present invention will be described with reference to FIGS. 13 to 15. In these drawings, equivalent members to those shown in FIGS. 3 and 8 are denoted by the same reference numerals and will not be explained here.

Figure 13:
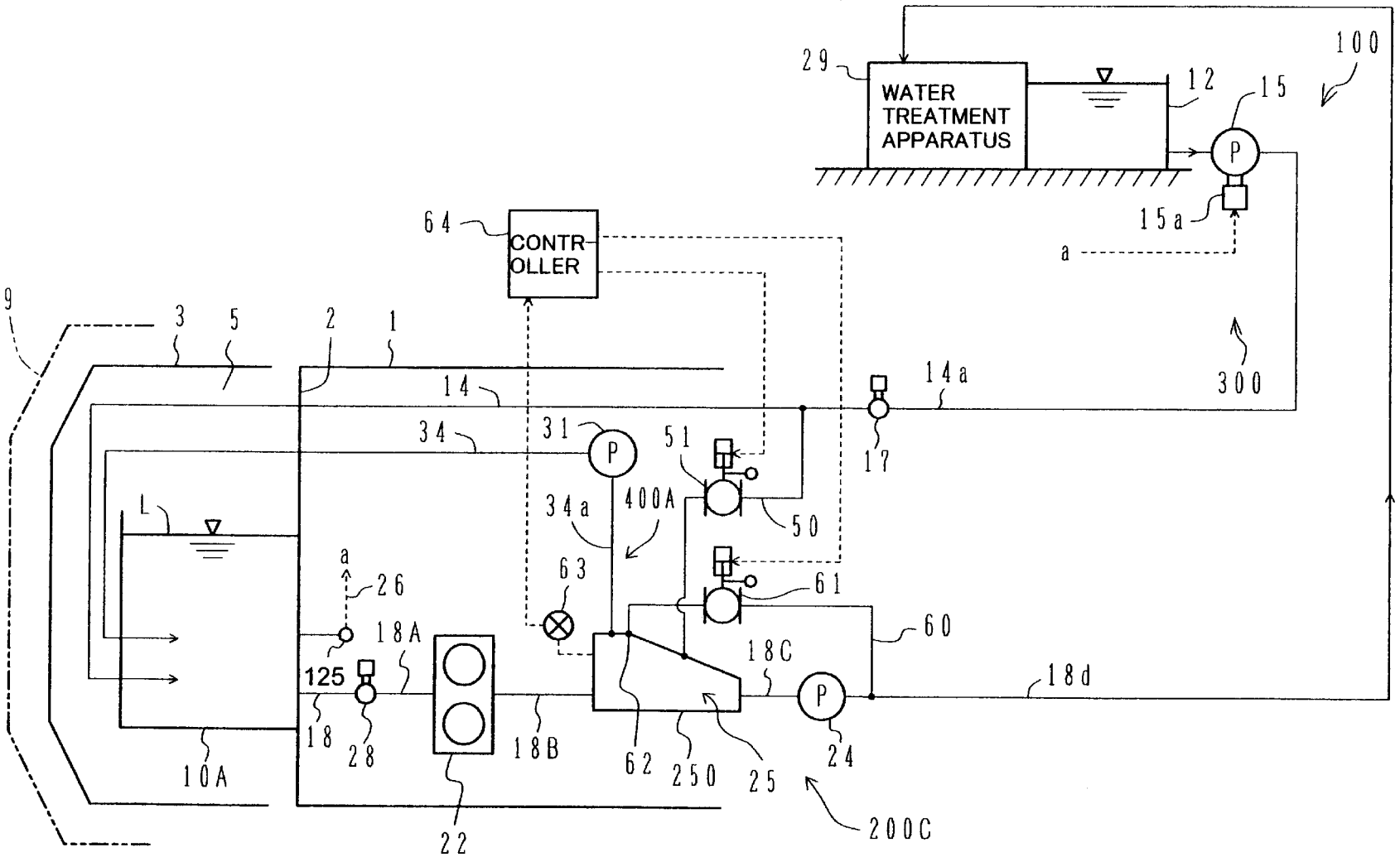
FIG. 13 is a diagram showing a carrying fluid supply/discharge system for a tunnel boring machine according to a fifth embodiment of the present invention.

Referring to FIG. 13, a suction/discharge system 200C installed in a tunnel boring machine of this embodiment includes, instead of the open tank 23 shown in FIG. 8, a flow divider 25 having a closed tank 250. The water including the earth and sent from the open tank 10A is divided by the flow divider 25 into water including gravel-like rock fragments and water including no gravel-like rock fragments. The flow divider 25 is positioned downstream of the crusher 22, and a suction pump is not provided between the open tank 10A and the crusher 22. In other words, the flow divider 25 is connected to the open tank 10A through the suction pipes 18, 18A, the crusher 22 and the suction pipe 18B. The discharge pump 24 serving also as a suction pump is connected to the flow divider 25 on the downstream side through the suction pipe 18C. The water including gravel-like rock fragments, branched by the flow divider 25, is sucked by the discharge pump 24 and delivered under pressure to the water treatment apparatus 29 on the ground surface through the discharge pipe 18*d*.

Connected to an upper portion of the flow divider 25 is a carrying fluid return system 400A for returning, to the open tank 10A, the water that is branched by the flow divider 25 and includes no gravel-like rock fragments. The carrying fluid return system 400A has a return pump 31 of the volute type which is one of centrifugal pumps. The flow divider 25 is connected to the return pump 31 through a suction pipe 34*a* and further to the open tank 10A through a return pipe 34. In this embodiment, the carrying fluid return system 400A functions also as part of the suction/discharge system 200C such that the water in the open tank 10A is sucked together with the earth by both the return pump 31 and the discharge pump 24 through the flow divider 25.

Also in this embodiment, as with the third embodiment, the suction pipes 18, 18A interconnecting the open tank 10A and the crusher 22 each have a larger diameter than the suction pipes 18B, 18C and the discharge pipe 18*d* downstream of the crusher 22 so that larger rock fragments before being crushed by the crusher 22 can pass the former pipes. A total flow rate of the delivery flow rate provided by the discharge pump 24 and the return flow rate provided by the return pump 31 is allowed to flow through the suction pipes 18, 18A each having a larger diameter.

As one example, this embodiment uses the suction pipes 18, 18A each having a diameter of 6 inches, and the suction pipes 18B, 18C and the discharge pipe 18*d* each having a diameter of 4 inches. In that case, if the return flow rate provided by the return pump 31 is set to be substantially equal to the delivery flow rate provided by the discharge pump 24, a suction flow rate through the suction pipes 18, 18A is about twice the delivery flow rate provided by the discharge pump 24 and a flow speed in the suction pipes 18, 18A can be surely maintained at such a value (e.g., 3 m/sec or more) as required to prevent the rock fragments from sinking down to the pipe bottom. Because the water flows through the suction pipes 18, 18A and the suction pipe 18B at the same flow rate in spite of the suction pipe 18B having a smaller diameter, a flow speed in the suction pipe 18B is about twice the flow speed in the suction pipes 18, 18A. Also, because the water in the suction pipe 18C and the discharge pipe 18*d* is sucked by only the discharge pump 24, a flow speed in the suction pipe 18C and the discharge pipe 18*d* is substantially equal to the flow speed in the suction pipes 18, 18A in spite of the pipes 18C, 18*d* having the same diameter as the suction pipe 18B. Of course, the suction pipe 18B having the same diameter, i.e., 6 inches, as the suction pipe may be used.

An air purge port 62 is formed in an upper portion of the flow divider 25 and connected through an air purge pipe 60 to the discharge pipe 18*d* on the delivery side of the discharge pump 24. An opening/closing valve 61 with an actuator is disposed in the air purge pipe 60. The supply pipe and the flow divider 25 are interconnected by a water pouring pipe 50 in which is disposed an opening/closing valve 51 with an actuator. Further, the flow divider 25 is provided with an air sensor 63 for detecting the presence of air in the flow divider 25. The air sensor 63 can comprise, for example, a float or a sensor for detecting the presence of air from the difference in electrical resistance between water and air. A signal of the air sensor 63 is sent to a controller 64. When the presence of air is detected by the air sensor 63, the controller 64 opens the opening/closing valve 51 with the actuator, causing water to be supplied from the supply pipe 14 to the flow divider 25 through the water pouring pipe 50. The water level in the flow divider 25 is thereby so elevated that the air in the flow divider 25 is purged out to the discharge pipe 18*d* through the air purge pipe 60.

Figure 14:
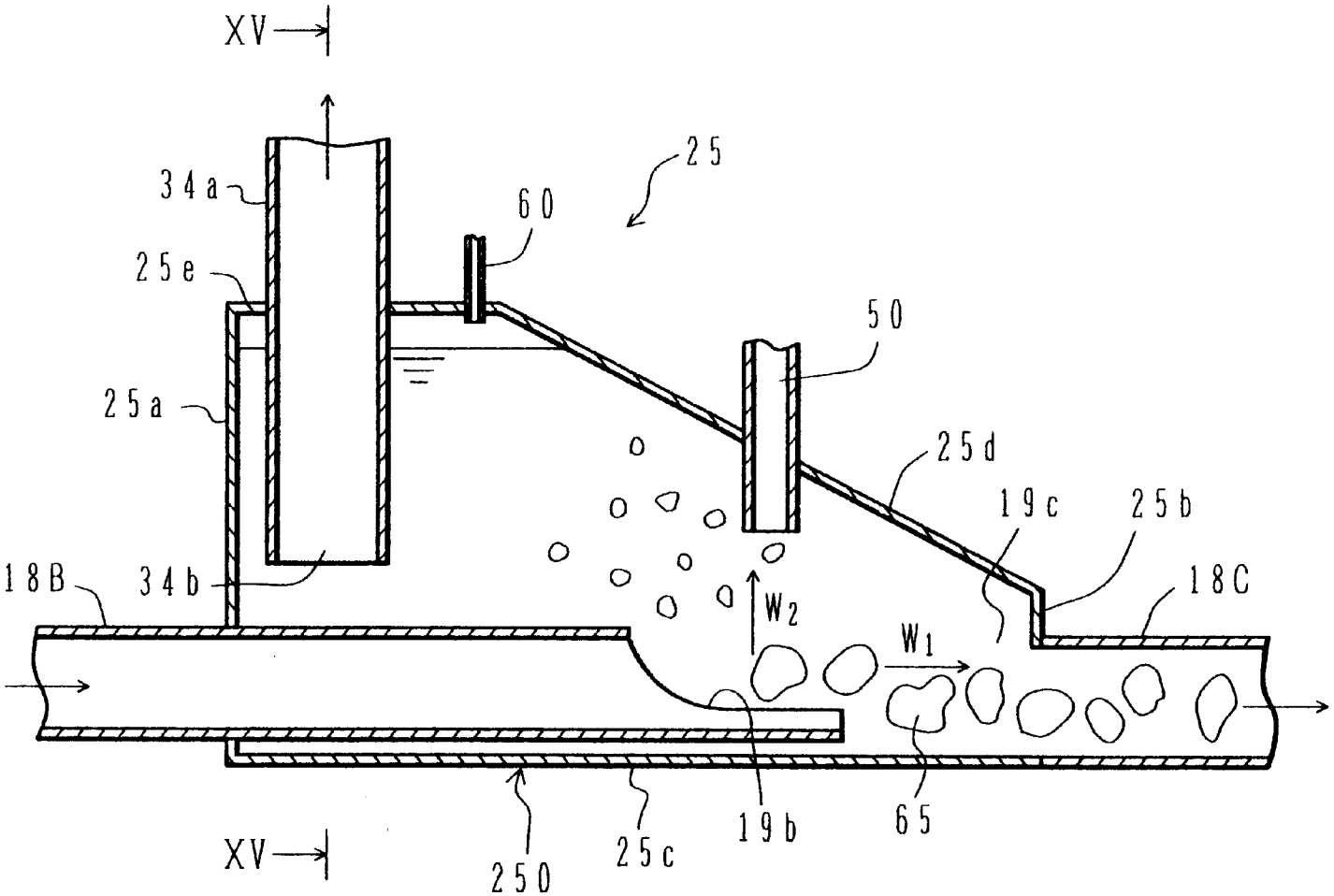
FIG. 14 is a view showing a construction of a flow divider shown in FIG. 13.
Figure 15:
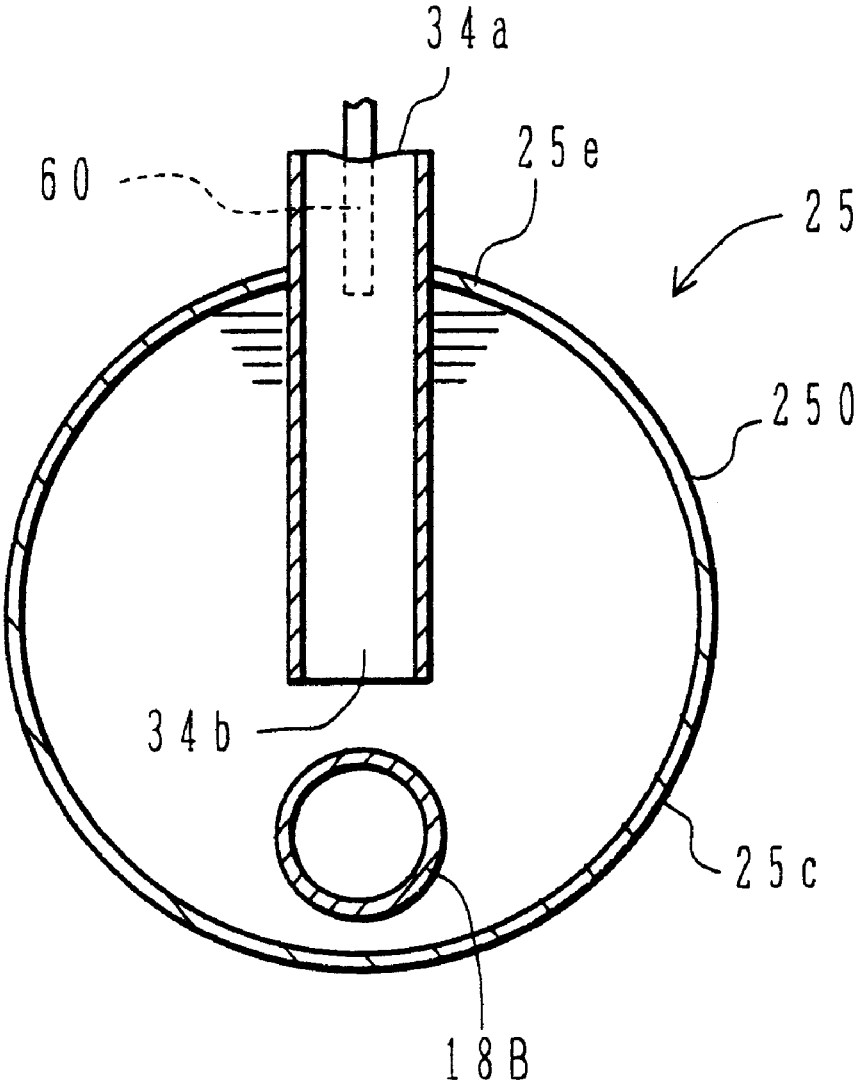
FIG. 15 is a sectional view taken along line XV—XV in FIG. 14.

The structure of the flow divider 25 is shown in FIGS. 14 and 15. The closed tank 250 constituting a body of the flow divider 25 is made up of an end plate 25*a* on the upstream side, an end plate 25*b* on the downstream side, and a cylindrical portion 25*c*. The cylindrical portion 25*c* is configured to have a sloped area 25*d* and a horizontal area 25*e* which are positioned to define an upper wall of the cylindrical portion 25*c*. A suction port 19*c* of the suction pipe 18C connected to the discharge pump 24 is opened at a lower portion of the end plate 25*b*, while the suction pipe 18*b* connected to the crusher 22 penetrates a lower portion of the end plate 25*a* and then extends up to a position within the closed tank 25 near its intermediate portion. A large opening 19*b* being open upward is formed in an end portion of the suction pipe 18B in continuous relation to an end opening thereof. Accordingly, a flow speed of the carrying fluid flowing upward from the opening 19*b* is smaller than that of the carrying fluid flowing straight toward the suction port 19*c*. As a result, the water including the earth and sent from the open tank 10A is divided into water including gravel-like rock fragments 65 and water not including the gravel-like rock fragments 65, following which only the water including the gravel-like rock fragments 65 is sucked through the suction port 19*c*.

Further, the suction pipe 34*a* of the return system 400A penetrates the upper horizontal area 25*e* of the cylindrical portion 25*c*, and has a suction port 34*b* being open in a lower portion of the closed tank 250 at a position above the suction pipe 18B so that the water branched through the opening 19*b* and not including gravel-like rock fragments 65 is sucked through the suction port 34*b*. The gravel-like rock fragments 65 which are heavier than water are hardly sucked through the suction port 34*b*.

The air purge pipe 60 also penetrates the upper horizontal area 25*e* of the cylindrical portion 25*c*, and slightly extends into the cylindrical portion 25*c*, thus enabling air accumulating in an upper space of the flow divider 25 to be purged out. Additionally, the water pouring pipe 50 extends into the cylindrical portion 25*c* while penetrating a central portion of the upper sloped area 25*d*.

In this embodiment thus constructed, when the discharge pump 24 and the return pump 31 are operated, suction forces of the discharge pump 24 and the return pump 31 are transmitted to the open tank 10A through the flow divider 25 because the flow divider 25 is constituted by the closed tank 250, whereupon the water residing in the open tank 10A and including the earth is sucked into the flow divider 25. The water including the earth and sucked into the flow divider 25 is divided, as stated above, in the flow divider 25 into the water including the gravel-like rock fragments 65 and the water not including the gravel-like rock fragments 65. The water including the gravel-like rock fragments 65 forms a straight stream W1 flowing from the opening 19*b* of the suction pipe 18B toward the suction port 19*c* of the suction pipe 18C, following which that water is sucked by the suction force of the discharge pump 24 through the suction port 19*c* and then delivered under pressure to the water treatment apparatus 29 on the ground surface through the discharge pipe 18*d*.

On the other hand, the water not including the gravel-like rock fragments 65 forms a rising stream W2 with a lower speed than the above straight stream and is branched from the straight stream W1 at the opening 19*b* of the suction pipe 18B. The thus-branched water further rises along the upper sloped area 25*d* of the cylindrical portion 25*c* and accumulates to reach a space below the upper horizontal area 25*e*, thereby being stored in the closed tank 250. Then, that water is sucked by the suction force of the return pump 31 through the suction port 34*b* of the suction pipe 34*a* and returned to the open tank 10A.

Bubbles mixed in the rising stream W2 form an air layer including the bubbles and residing below the upper horizontal area 25*e*. When the air sensor 63 detects the presence of the air layer, a detection signal of the air sensor 63 is sent to the controller 64 which controls the opening/closing valves 51, 61 to be opened, whereupon water is poured into the flow divider 25 and the air accumulating in the upper space of the flow divider 25 is pushed into the air purge pipe 60 for purging-out through the discharge pipe 18*d*. Thus a reduction in efficiency caused upon the return pump 31 and the discharge pump 24 sucking air can be prevented.

With this embodiment, as explained above, since the flow divider 25 is constituted by the closed tank 250 and the water in the open tank 10A is sucked by the discharge pump 24 and the return pump 31 both disposed downstream of the flow divider 25, the water in the open tank 10A can be sucked and discharged together with the earth without any pump provided between the open tank 10A and the flow divider 25.

Also, as with the third embodiment, since a flow rate of the carrying fluid delivered from the open tank 10A to the flow divider 25 is increased by an amount corresponding to the return flow rate provided by the return pump 31, a flow speed required for carrying the larger rock fragments can be ensured even with the suction pipe 18 increased in diameter.

Further, since the water not including the gravel-like rock fragments 65 and residing in the flow divider 25 is returned by the return pump 31 to the open tank 10A, the amount of water in the open tank 10A is replenished by the returned water, resulting in that the supply flow rate of the water from the supply tank 12 on the ground surface can be saved and the system can be operated with better efficiency.

Additionally, since the air accumulating in the upper space of the flow divider 25 is discharged through the air purge pipe 60, it is possible to prevent a reduction in efficiency caused upon the return pump 31 and the discharge pump 24 sucking air.

A sixth embodiment of the present invention will be described with reference to FIG. 16. In the drawing, equivalent members to those shown in FIGS. 1, 12 and so on are denoted by the same reference numerals and will not be explained here.

Figure 16:
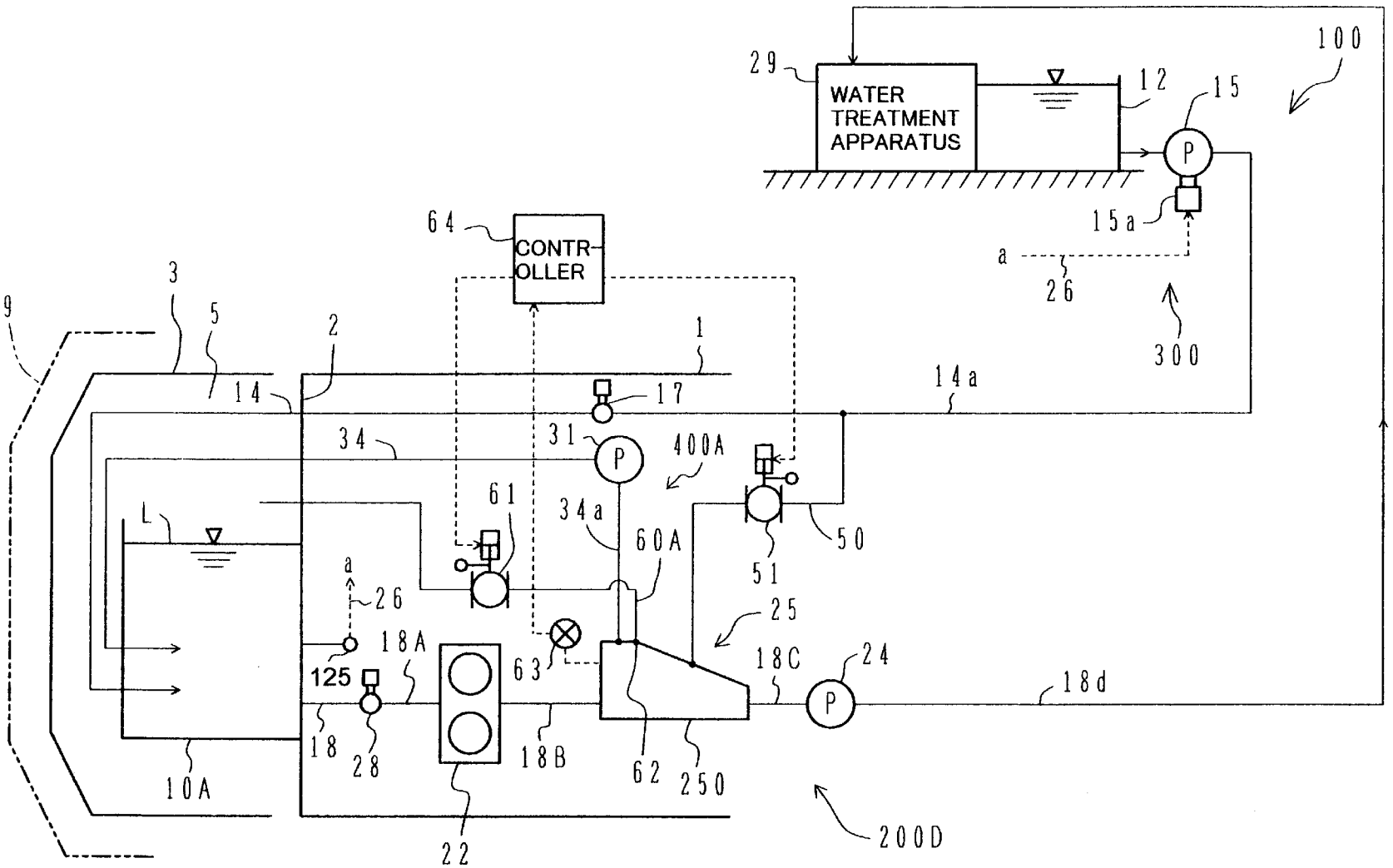
FIG. 16 is a diagram showing a carrying fluid supply/discharge system for a tunnel boring machine according to a sixth embodiment of the present invention.

Referring to FIG. 16, a suction/discharge system 200D installed in a tunnel boring machine of this embodiment includes, instead of the air purge pipe 60 connected to the discharge pipe 18*d*, an air purge pipe 60A provided to extend to a position above the water surface in the open tank 10A for purging out the air accumulating in the upper space of the flow divider 25 to a space above the water surface in the open tank 10A. In this case, the air purged out of the air purge pipe 60A is not mixed into the water in the open tank 10A. Further, the water sucked along with the air through the air purge pipe 60A is returned to the open tank 10A.

With this embodiment, the water sucked along with the air is returned to the open tank 10A without making the air mixed into the water in the open tank 10A, and therefore the flow rate of water returned from the flow divider 25 to the open tank 10A can be further increased correspondingly. Further, air can be avoided from being mixed into the water including the earth and discharged through the discharge pipe 18*d*.

A seventh embodiment of the present invention will be described with reference to FIG. 17. In the drawing, equivalent members to those shown in FIGS. 1, 12 and so on are denoted by the same reference numerals and will not be explained here.

Figure 17:
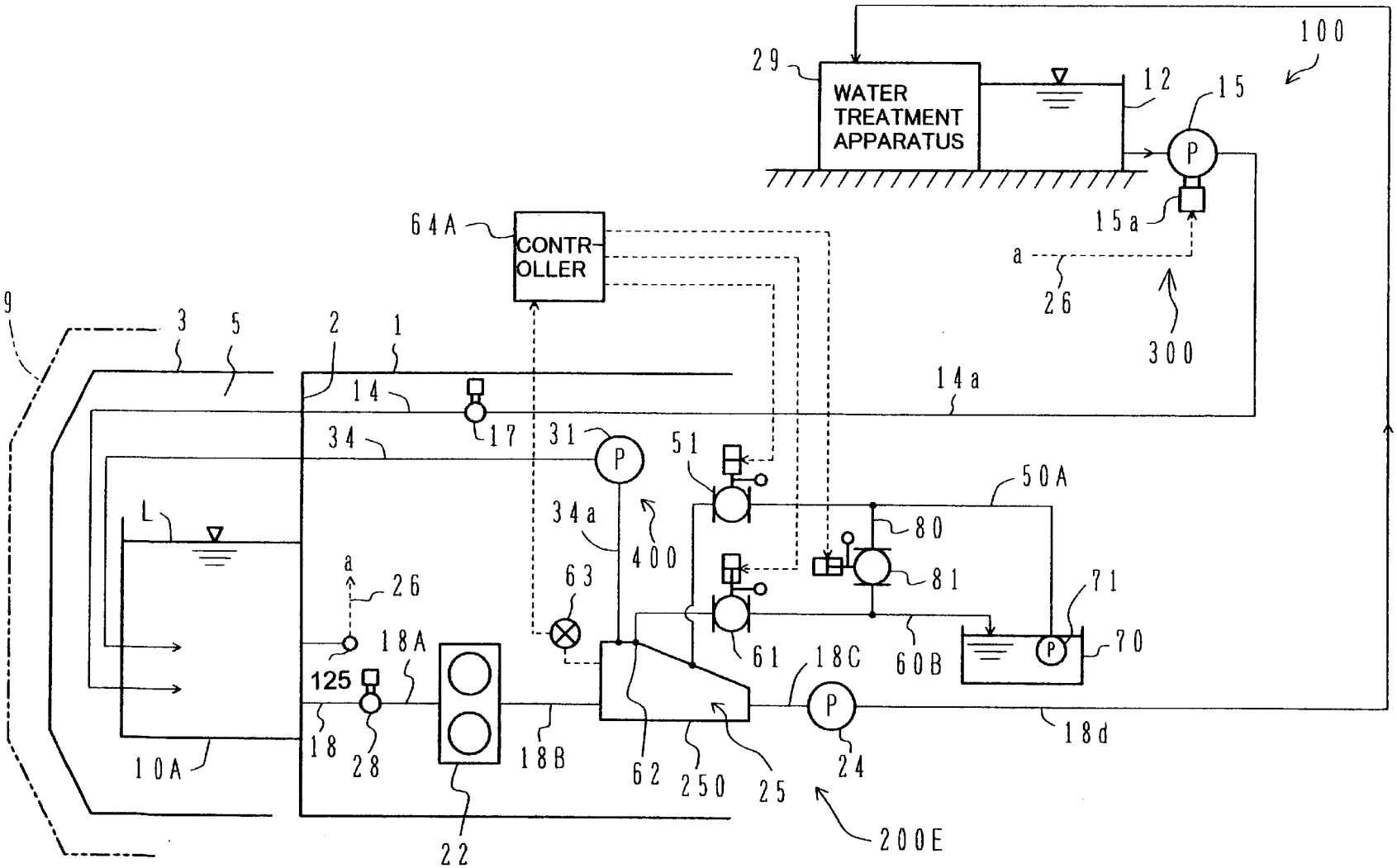
FIG. 17 is a diagram showing a carrying fluid supply/discharge system for a tunnel boring machine according to a seventh embodiment of the present invention.

Referring to FIG. 17, a suction/discharge system 200E installed in a tunnel boring machine of this embodiment includes an open tank 70, an air purge pipe 60B extending to the open tank 70 instead of the air purge pipe 60 connected to the discharge pipe 18*d*, and a water pouring pipe 50A connected to the open tank 70 instead of the water pouring pipe 50 connected to the supply pipe 14*a*, the water pouring pipe 50A being provided with a supply pump 71. Further, the water pouring pipe 50A and the air purge pipe 60B are connected to each other by a bypass pipe 80, and an opening/closing valve 81 with an actuator is provided in the bypass pipe 80. The valve 81 is opened and closed in response to a signal from a controller 64A.

In this embodiment, the supply pump 71 is operated continuously, and the valve 81 in the bypass pipe 80 is opened when the presence of air is not detected by the air sensor 63, thereby causing water to circulate between the open tank 70 and the bypass pipe 80. When the presence of air is detected by the air sensor 63, the valve 81 in the bypass pipe 80 is closed, but the valves 51, 61 in the water pouring pipe 50A and the air purge pipe 60B are opened so that water is circulated between the flow divider 25 and the supply pump 71 to purge air out of the flow divider 25.

With this embodiment, air can be purged out of the flow divider 25 without using the water in the supply tank 12.

An eighth embodiment of the present invention will be described with reference to FIGS. 18 and 19. In these drawings, equivalent members to those shown in FIGS. 1, 12, 13 and so on are denoted by the same reference numerals and will not be explained here.

Figure 18:
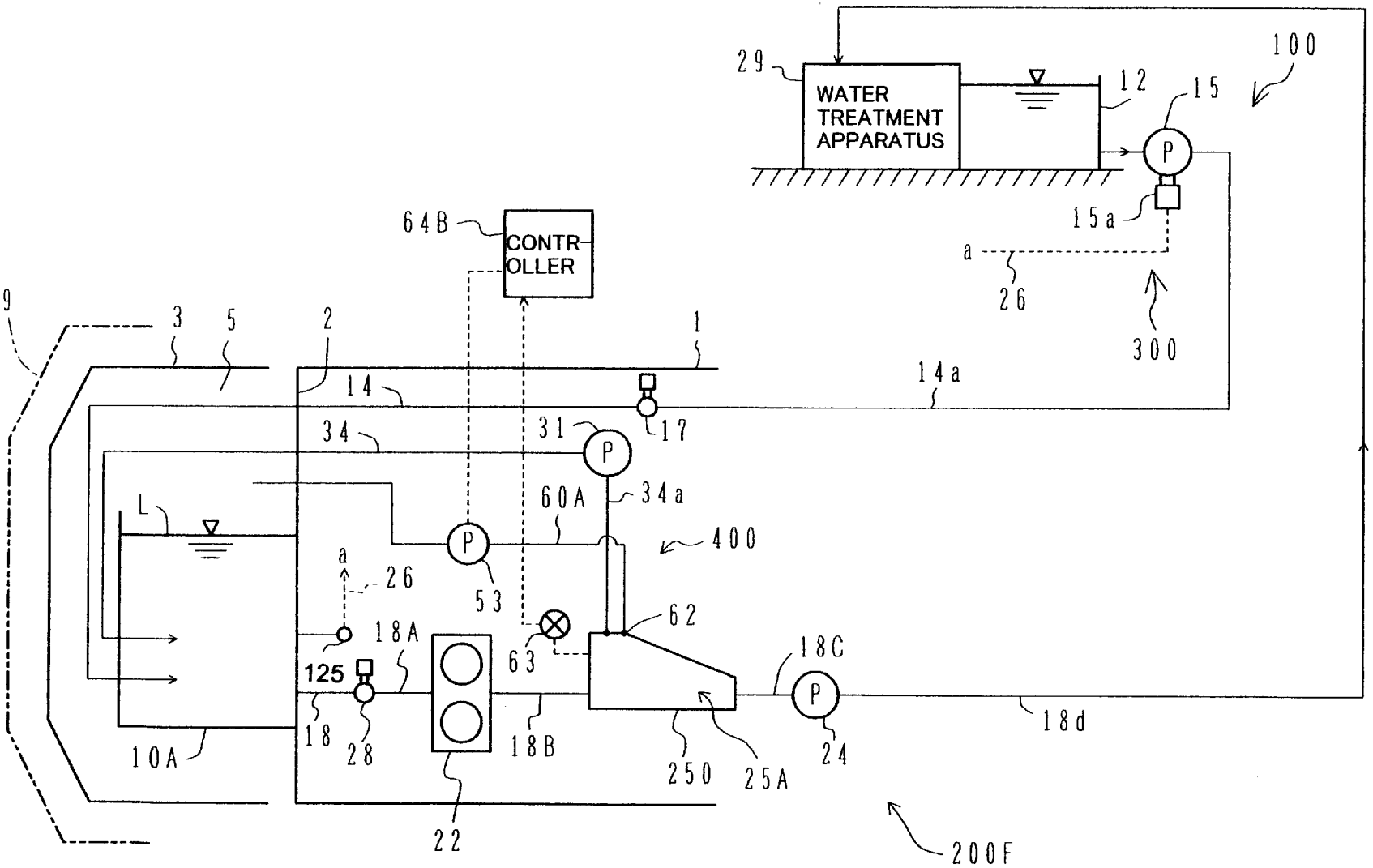
FIG. 18 is a diagram showing a carrying fluid supply/discharge system for a tunnel boring machine according to an eighth embodiment of the present invention.

Referring to FIG. 18, a suction/discharge system 200F installed in a tunnel boring machine of this embodiment includes the air purge pipe 60A connected to a flow divider 25A, a vacuum pump 53 provided in the air purge pipe 60A for forcibly sucking and removing air accumulating in an upper space of the flow divider 25A, and a controller 64B for sending a signal to the vacuum pump 53 in response to the signal from the air sensor 63.

When the air sensor 63 detects that air is accumulated in the upper space of the flow divider 25A, a resulting detection signal is sent to the controller 64B which controls the vacuum pump 53 to rotate for purging the air accumulating in the upper space of the flow divider 25A to be purged out to the space above the open tank 10A through the air purge pipe 60A. Note that the vacuum pump 53 may be rotated at all times instead of providing the air sensor 63 and the controller 64B.

Figure 19:
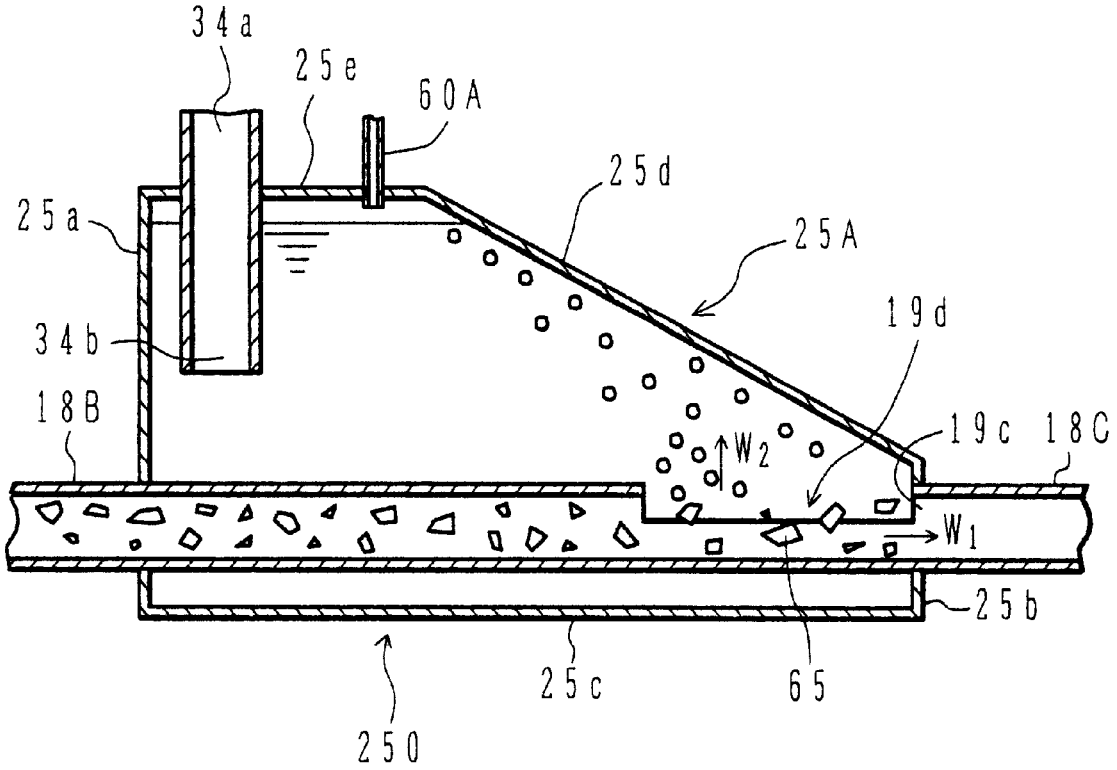
FIG. 19 is a view showing a construction of a flow divider shown in FIG. 18.

The structure of the flow divider 25A is shown in FIG. 19. The suction pipe 18*c* penetrates a lower portion of the end plate 25*b*, while the suction pipe 18*b* connected to the crusher 22 penetrates a lower portion of an end wall 25*a* on the upstream side of the closed tank 250, then extends up to an end wall 25*b* on the downstream side thereof, and is joined to the suction port 19*c* of the suction pipe 18C. An opening 19*d* being open upward is formed in an end portion of the suction pipe 18B adjacent the end wall 25*b*, and has an opening area larger than the sectional area of the suction pipe 18B. As with the flow divider 25 explained above in connection with the fifth embodiment, therefore, the water including the earth and sucked into the flow divider 25A is divided in the flow divider 25A into the water including the gravel-like rock fragments 65 and the water not including the gravel-like rock fragments 65. The water including the gravel-like rock fragments 65 forms a straight stream W1 flowing from the suction pipe 18B toward the suction pipe 18C, following which that water is sucked by the suction force of the discharge pump 24 and then delivered to the water treatment apparatus 29 on the ground surface through the discharge pipe 18*d*.

On the other hand, the water not including the gravel-like rock fragments 65 forms a rising stream W2 with a lower speed than the above straight stream and is branched from the straight stream W1 at the opening 19*d* of the suction pipe 18B. The thus-branched water is sucked by the suction force of the return pump 31 through the suction port 34*b* of the suction pipe 34*a* and returned to the open tank 10A.

Further, because air in the flow divider 25A is forcibly sucked and removed by the vacuum pump 53, the water pouring pipe 50 provided to be open to the flow divider 25 is not provided in this embodiment.

The remaining structure of the flow divider 25A is the same as that of the flow divider 25.

With this embodiment, since air in the flow divider 25A can be purged out without providing the water pouring pipe 50 to be open to the flow divider 25A, the structure for purging out air is simplified.

Figure 20:
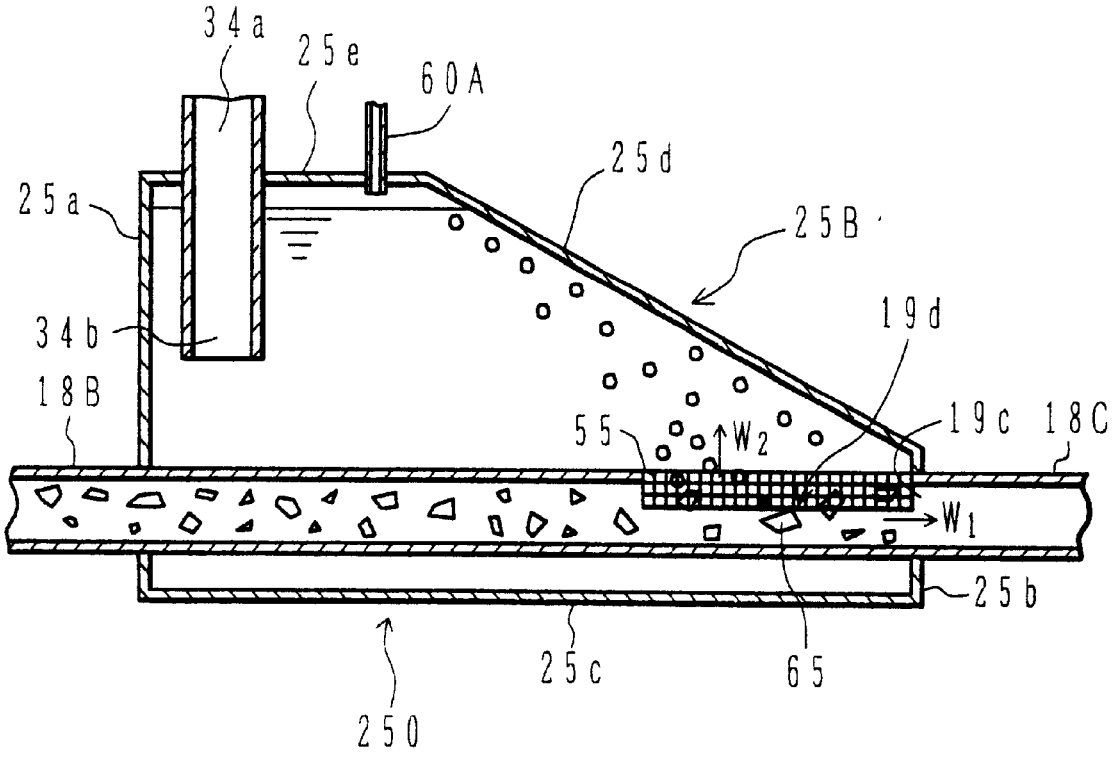
FIG. 20 is a view showing a construction of a flow divider according to a modification of the eighth embodiment.

A modification of the eighth embodiment is shown in FIG. 20.

The opening 19*d* formed in a portion of the suction pipe 18B inside a flow divider 25B may be covered with a net instead of being made freely open, or may comprise a series of gaps or a number of through holes instead of a single opening. FIG. 20 shows a modification in which the opening 19*d* is covered with a net 55. With this structure, the rock fragment 65 can be completely prevented from jumping out from the opening 19*d* of the suction pipe 18B. It is to be noted that when the opening 19*d* is thus covered with the net 55, the opening 19*d* is not necessarily provided on the upper side of the suction pipe 18B in the end portion thereof.

Figure 21:
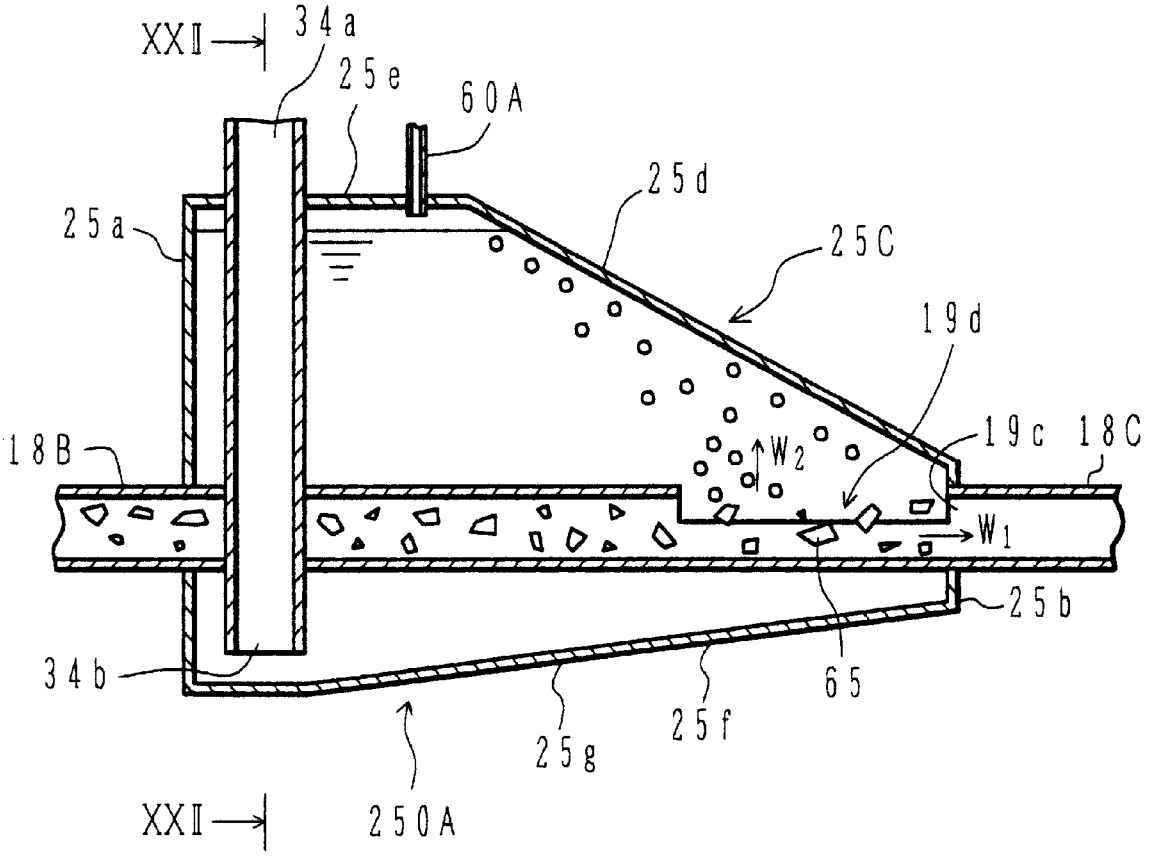
FIG. 21 is a view showing a construction of a flow divider according to another modification of the eighth embodiment.
Figure 22:
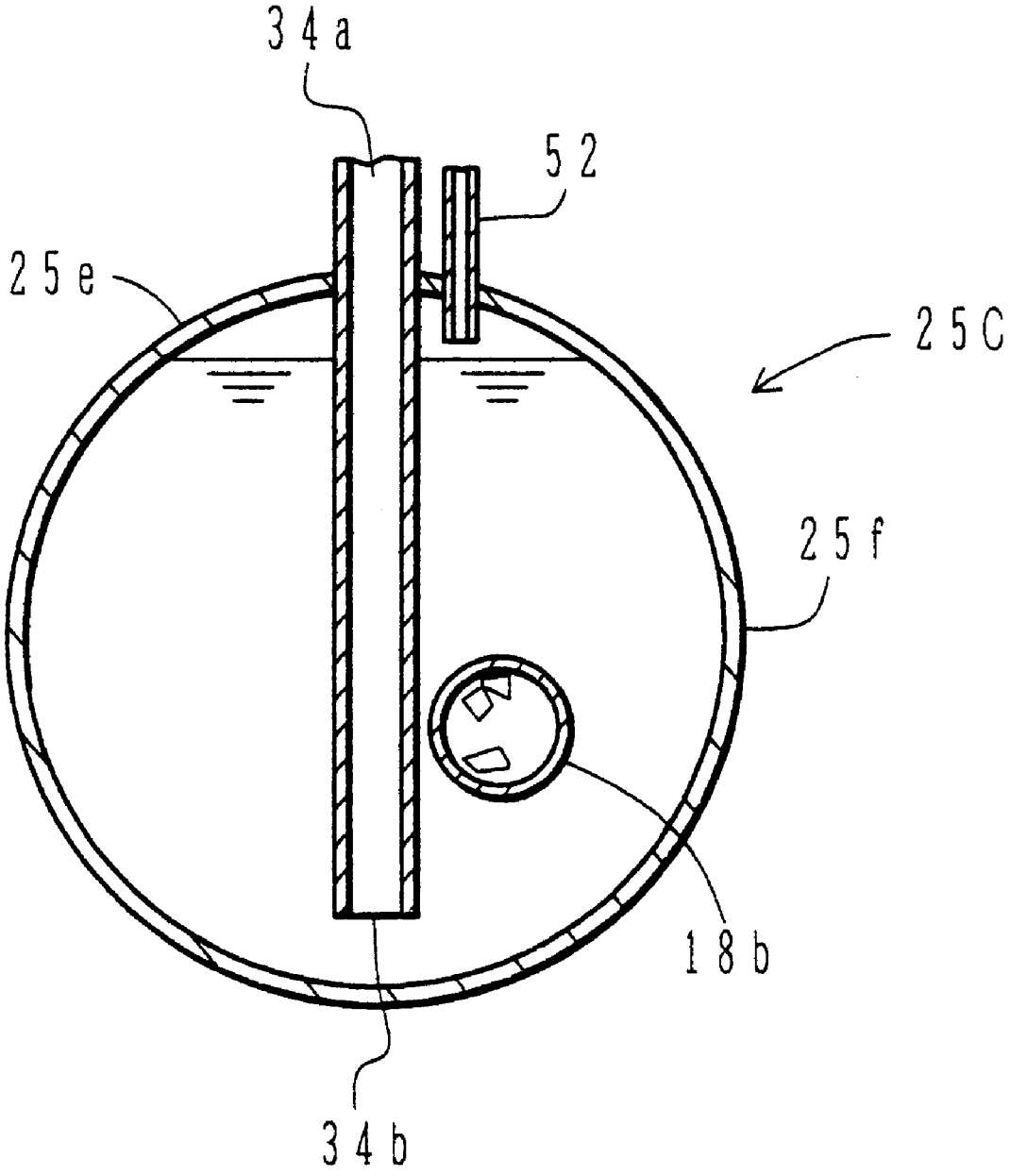
FIG. 22 is a sectional view taken along line XXII—XXII in FIG. 20.

Another modification of the eighth embodiment is shown in FIGS. 21 and 22. A closed tank 250A constituting a flow divider 25C is made up of end plates 25*a*, 25*b* and a cylindrical portion 25*f*. The cylindrical portion 25*f* has a bottom surface defined by a sloped surface 25*g* moderately inclining downward from the end plate 25*b* toward the end plate 25*a*. Also, the suction port 34*b* of the suction pipe 34*a* in the return system extends to a position below the suction pipe 18B and near the lowest portion of the downward sloped surface 25*g*.

By so constructing the flow divider 25C, should some of the rock fragments 65 jump out from the opening 19*d* of the suction pipe 18B, those rock fragments 65 are moved to the side of the suction pipe 34*a* in the return system along the sloped surface 25*g*, sucked through the suction port 34*b* of the suction pipe 34*a* along with the water, and then delivered to the open tank 10A. It is therefore possible to prevent the rock fragments 65 from being accumulated inside the flow divider 25C in such a large number as impeding proper branching of the water in the flow divider 25C.

According to the present invention, since the water in the open tank is sucked and discharged together with the excavated earth by the suction pump while maintaining the proper water level in the open tank, it is possible to prevent clogging caused by small stones or the like that has been experienced in such a small-diameter nozzle as in a jet pump, and to discharge the earth smoothly and continuously. As a result, interruption of the boring work is reduced, the problems incidental to the interruption of the boring work, i.e., need of more labor and extension of the term of works, are eliminated, and a reduction in the term of works and the construction cost can be achieved.

When using a jet pump, its application is limited to tunnel boring machines having a small diameter because of a carrying function specific to the jet pump. On the other hand, according to the present invention, the earth carrying-out capability can be easily increased by control of the supply amount and the suction/discharge amount, and the application field can be made broader to cover tunnel boring machines ranging from a small diameter to a medium diameter. Further, the broader application field can eliminate the need of changing the working method depending on the machine diameter.

Additionally, since no nozzle is employed, unlike the case of using a jet pump, the lower portion of the open tank is avoided from having a complicated structure and the entire system can be made simpler.

What is claimed is:

1. A tunnel boring method of collecting earth excavated upon rotation of a cutter disk in a non-pressurized chamber behind said cutter disk and discharging the earth with a carrying fluid being mainly water, said method comprising the steps of:

arranging an open tank, serving as a vessel for containing said carrying fluid as well as a hopper for collecting the excavated earth, in said chamber on the back side of said cutter disk, supplying said carrying fluid to said open tank, sucking and discharging said carrying fluid supplied to said open tank rearward together with the collected earth, and monitoring a water level of said carrying fluid in said open tank and keeping the water level between a minimum water level and a maximum water level.

2. A tunnel boring machine for collecting earth excavated upon rotation of a cutter disk in a non-pressurized chamber behind said cutter disk and discharging the earth with a carrying fluid being mainly water, said apparatus comprising:

a first open tank arranged in said chamber on the back side of said cutter disk for serving as a vessel for containing said carrying fluid as well as a hopper for collecting the excavated earth, carrying fluid supply means for supplying said carrying fluid to said first open tank, suction/discharge means for sucking and discharging said carrying fluid supplied to said first open tank rearward together with the collected earth, and water level control means for monitoring a water level of said carrying fluid in said first open tank and keeping the water level between a minimum water level and a maximum water level.

3. A tunnel boring machine according to claim 2, wherein said carrying fluid supply means includes a supply pipe connected to said first open tank, and a pouring port of said supply pipe is positioned below said minimum water level.

4. A tunnel boring machine according to claim 2, wherein said suction/discharge means includes at least one centrifugal pump.

5. A tunnel boring machine according to claim 2, wherein said suction/discharge means includes a suction pipe connected to said first open tank, and said water level control means controls the water level with a target water level Lo expressed by;

$$Lo \geqq 2d + (\Delta h/2)$$

Where Lo is the target water level, Δh is the difference between the minimum and maximum water levels and d is the diameter of a suction port of said suction pipe.

6. A tunnel boring machine according to, one of claims 2, 3 and 5 wherein said carrying fluid supply means includes a supply pump for delivering said carrying fluid under pressure to said first open tank from the ground surface, and said water level control means comprises water level detecting means for detecting the water level of said carrying fluid in said first open tank and means for controlling said supply pump of said carrying fluid supply means in accordance with a value detected by said water level detecting means.

7. A tunnel boring machine according to claim 6, wherein said water level detecting means includes a water-pressure gauge for detecting a water pressure at the bottom of said first open tank and estimating the water level from the pressure detected by said water-pressure gauge.

8. A tunnel boring machine according to claim 6, wherein said water level control means further comprises suction flow rate control means for controlling a suction flow rate provided by said suction/discharge means in accordance with the value detected by said water level detecting means.

9. A tunnel boring machine according to claim 8, wherein said water level detecting means includes a water-pressure gauge for detecting a water pressure at the bottom of said first open tank and estimating the water level from the pressure detected by said water-pressure gauge.

10. A tunnel boring machine according to claim 2, wherein said carrying fluid supply means includes a first supply pipe connected to said first open tank, said suction/discharge means includes a suction pipe connected to said first open tank, and said first open tank comprises opposing sloped plates in pairs extending in the axial direction of said cutter disk and sloped to come closer to each other as the plates slope downwardly, and a bottom curved piece continuously joined to lower ends of said opposing sloped plates to define a bottom passage in said first open tank, said suction pipe having a suction port positioned at a rear end of said bottom passage, said first supply pipe having a pouring port positioned at a front end of said bottom passage to face the suction port of said suction pipe.

11. A tunnel boring machine according to claim 10, wherein said carrying fluid supply means further includes a second supply pipe connected to said first open tank, and a pouring port of said second supply pipe is portioned obliquely toward said bottom passage at a level above the pouring port of said first supply pipe.

12. A tunnel boring machine according to claim 11, further comprising carrying fluid return means for returning part of the carrying fluid discharged by said suction/discharge means, wherein one of said first supply pipe and said second supply pipe is a return pipe of said carrying fluid return means.

13. A tunnel boring machine according to claim 2, further comprising an air-purging second open tank allowing at least part of the carrying fluid including the earth and delivered from said first open tank to reside therein, a crusher provided between said first open tank and said second open tank for crushing rock fragments included in the earth discharged along with said carrying fluid, and a discharge pump provided downstream of said second open tank for delivering under pressure the carrying fluid in said second open tank together with the earth to the ground surface, wherein said suction/discharge means is provided between said first open tank and said crusher and includes a suction pump for sucking the carrying fluid in said first open tank together with the earth.

14. A tunnel boring machine according to claim 13, further comprising carrying fluid return means including a return pump for returning the carrying fluid in said second open tank to said first open tank, wherein a suction flow rate provided by said suction pump is set to be grater than a delivery flow rate provided by said discharge pump, and a return flow rate provided by said return pump is set to be substantially equal to a differential flow rate between said suction flow rate and said delivery flow rate.

15. A tunnel boring machine according to claim 13, wherein an air purge pipe is connected to a suction pipe between said first open tank and said suction pump, and a vacuum pump for forcibly sucking and removing air in the carrying fluid flowing through said suction pipe is provided in said air purge pipe.

16. A tunnel boring machine according to claim 13, wherein said carrying fluid supply means includes a supply pipe connected to said first open tank, said suction/discharge means includes a suction pipe connected to said first open tank, said carrying fluid return means including a return pipe connected to said first open tank, and said first open tank comprises opposing sloped plates in pairs extending in the axial direction of said cutter disk and sloped to come closer to each other as the plates slope downwardly, and a bottom curved piece continuously joined to lower ends of said opposing sloped plates to define a bottom passage in said first open tank, said suction pipe having a suction port positioned at a rear end of said bottom passage, said supply pipe having a pouring port positioned at a front end of said bottom passage, and said return pipe having a pouring port positioned obliquely toward said bottom passage at a level above the pouring port of said supply pipe.

17. A tunnel boring machine according to claim 2, wherein said suction/discharge means comprises a flow divider having a closed tank to which the carrying fluid including the earth is delivered from said first open tank, and dividing said carrying fluid into a carrying fluid including gravel-like rock fragments having a diameter greater than 2 mm in the earth and a carrying fluid including rock fragments smaller than 2 mm, a discharge pump provided downstream of said flow divider for sucking and delivering under pressure the carrying fluid branched in said closed tank and including gravel-like rock fragments to the ground surface, and carrying fluid return means including a return pump for sucking and returning the carrying fluid branched in said closed tank and including no gravel-like rock fragments to said first open tank, said return pump and said discharge pump cooperatively sucking and discharging the carrying fluid in said first open tank together with the earth through said flow divider.

18. A tunnel boring machine according to claim 17, wherein a crusher for crushing the rock fragments included in the earth discharged along with said carrying fluid is provided between said first open tank and said flow divider.

19. A tunnel boring machine according to claim,17, wherein said flow divider includes a pipe member disposed in said closed tank for guiding the carrying fluid delivered from said first open tank and including the earth, and an opening is formed in a portion of said pipe member nearer to said discharge pump, said opening acting to divide the carrying fluid delivered from said first open tank and including the earth into a straight stream flowing straight toward said discharge pump and a rising stream flowing upward at a lower flow speed than said straight stream.

20. A tunnel boring machine according to claim 17, wherein an air purge pipe is connected to an upper panel of said closed tank of said flow divider, and a vacuum pump for sucking and removing air accumulating in an upper space of said closed tank is provided in said air purge pipe.

21. A tunnel boring machine according to claim 20, wherein said air purge pipe extends to said first open tank and introduces air sucked by said vacuum pump to a position above a fluid surface in said first open tank.

* * * * *